US011075029B2

(12) United States Patent
Banba et al.

(10) Patent No.: US 11,075,029 B2
(45) Date of Patent: Jul. 27, 2021

(54) COIL MODULE

(71) Applicant: Murata Manufacturing Co., Ltd., Kyoto (JP)

(72) Inventors: Shinichiro Banba, Kyoto (JP); Yoshihito Otsubo, Kyoto (JP); Norio Sakai, Kyoto (JP); Mitsuyoshi Nishide, Kyoto (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 1206 days.

(21) Appl. No.: 15/372,715

(22) Filed: Dec. 8, 2016

(65) Prior Publication Data

US 2017/0092415 A1 Mar. 30, 2017

Related U.S. Application Data

(63) Continuation of application No. PCT/JP2015/067565, filed on Jun. 18, 2015.

(30) Foreign Application Priority Data

Jun. 26, 2014 (JP) ..... JP2014-131472

(51) Int. Cl.
*H01F 27/28* (2006.01)
*H01F 17/06* (2006.01)
(Continued)

(52) U.S. Cl.
CPC ..... *H01F 27/2823* (2013.01); *H01F 17/0013* (2013.01); *H01F 17/062* (2013.01);
(Continued)

(58) Field of Classification Search
CPC .... H01F 27/2804; H01F 27/292; H01F 27/24; H01F 27/255; H01F 27/327;
(Continued)

(56) References Cited

U.S. PATENT DOCUMENTS

| | | | | |
|---|---|---|---|---|
| 5,225,969 | A | 7/1993 | Takaya et al. | |
| 2003/0127704 | A1 | 7/2003 | Kobayashi et al. | |
| 2005/0212642 | A1* | 9/2005 | Pleskach | H01L 23/49822 336/200 |
| 2009/0002111 | A1* | 1/2009 | Harrison | H01F 19/04 336/69 |

(Continued)

FOREIGN PATENT DOCUMENTS

| | | | |
|---|---|---|---|
| JP | H03-187208 | A | 8/1991 |
| JP | 2003-243570 | A | 8/2003 |
| JP | 2006-165212 | A | 6/2006 |

(Continued)

OTHER PUBLICATIONS

International Search Report for PCT/JP2015/067565 dated Sep. 8, 2015.
Written Opinion for PCT/JP2015/067565 dated Sep. 8, 2015.

*Primary Examiner* — Tszfung J Chan
(74) *Attorney, Agent, or Firm* — Pearne & Gordon LLP

(57) ABSTRACT

Substrate-side wiring electrode patterns 16, which form a part of a coil electrode 12, are provided on a wiring substrate 20, and as a result reductions in the size and profile of a resin insulating layer 31, in which a coil core 11 is buried, can be achieved. Therefore, reductions in the size and the profile of a coil module 1 can be achieved compared with a coil module of the related art which is formed by mounting a coil component on a wiring substrate. In addition, since the substrate-side wiring electrode patterns 16, which form a part of the coil electrode 12, are provided on the wiring substrate 20, the heat generated by a coil 10 can be efficiently released from the substrate-side wiring electrode patterns 16 to the wiring substrate 20. Therefore, the heat dissipation property of the coil module 1 can be improved at low cost.

20 Claims, 10 Drawing Sheets

(51) Int. Cl.
*H01F 17/00* (2006.01)
*H01F 27/29* (2006.01)

(52) U.S. Cl.
CPC ..... *H01F 27/2804* (2013.01); *H01F 27/2885* (2013.01); *H01F 27/2895* (2013.01); *H01F 27/29* (2013.01); *H01F 2027/2809* (2013.01)

(58) Field of Classification Search
CPC ..... H01F 2027/2809; H01F 17/0013; H01F 17/06; H01F 17/062; H01F 17/04; H01F 30/16; H01F 2038/305; H01F 41/0246
USPC ..... 336/200, 229, 232
See application file for complete search history.

(56) References Cited

U.S. PATENT DOCUMENTS

| | | | | |
|---|---|---|---|---|
| 2009/0273428 | A1* | 11/2009 | Chen | H01F 17/062 336/200 |
| 2014/0176286 | A1 | 6/2014 | Okada et al. | |
| 2015/0061817 | A1* | 3/2015 | Lee | H01F 17/0033 336/221 |
| 2015/0101854 | A1* | 4/2015 | Lee | H01F 41/046 174/260 |

FOREIGN PATENT DOCUMENTS

| | | | | |
|---|---|---|---|---|
| JP | 2006165212 | A | * | 6/2006 |
| JP | 2009-283771 | A | | 12/2009 |
| JP | 2010-516056 | A | | 5/2010 |
| JP | 2012-129364 | A | | 7/2012 |
| JP | 5270576 | B2 | | 5/2013 |
| WO | 2013/031842 | A1 | | 3/2013 |

* cited by examiner

COIL MODULE

This application is a continuation of International Application No. PCT/JP2015/067565 filed on Jun. 18, 2015 which claims priority from Japanese Patent Application No. 2014-131472 filed on Jun. 26, 2014. The contents of these applications are incorporated herein by reference in their entireties.

BACKGROUND OF THE DISCLOSURE

Field of the Disclosure

The present disclosure relates to a coil module that is equipped with a coil that includes a coil core and a coil electrode that is wound around the periphery of the coil core in a spiral shape.

Description of the Related Art

In the related art, a coil component 500 having a transformer formed thereinside has been proposed, as illustrated in FIG. 17. The coil component 500 includes a coil core 501 that is buried in a resin insulating layer (not illustrated), a first coil electrode 502*a* that forms a primary coil and a second coil electrode 502*b* that forms a secondary coil. In addition, the first and second coil electrodes 502*a* and 502*b* respectively include first and second outer columnar conductors 503*a* and 503*b*, which are arranged along an outer peripheral surface of the coil core 501, and first and second inner columnar conductors 504*a* and 504*b*, which are arranged along an inner peripheral surface of the coil core 501.

The first coil electrode 502*a*, which is wound around the periphery of the coil core 501 in a spiral shape, is formed by corresponding end portions of the first outer columnar conductors 503*a* and the first inner columnar conductors 504*a* being connected to each other by a plurality of first wiring electrode patterns 505*a* formed on both main surfaces of the resin insulating layer. In addition, the second coil electrode 502*b*, which is wound around the periphery of the coil core 501 in a spiral shape, is formed by corresponding end portions of the second outer columnar conductors 503*b* and the second inner columnar conductors 504*b* being connected to each other by a plurality of second wiring electrode patterns 505*b* formed on both main surfaces of the resin insulating layer.

Furthermore, the first and second coil electrodes 502*a* and 502*b* respectively include primary and secondary coil electrode pairs 506*a* and 506*b* and primary and secondary coil center taps 507*a* and 507*b*. In FIG. 17, the second wiring electrode patterns 505*b*, the secondary coil electrode pair 506*b* and the secondary coil center tap 507*b*, which form the secondary coil, are shaded with hatching.

Patent Document 1: Japanese Patent No. 5270576 (refer to paragraphs 0044-0046, FIG. 3, etc.)

BRIEF SUMMARY OF THE DISCLOSURE

Incidentally, a coil module having various functions is formed by mounting the above-described coil component 500 on a wiring substrate (not illustrated), but, in recent years, reductions in the size and profile of a coil module formed in this way have been demanded. However, the coil component 500 is typically larger than passive components such as chip capacitors and chip inductors and functional components such as switching elements. Consequently, there is a problem in that a coil module in which the coil component 500 is mounted is increased in size and profile.

Therefore, there is a demand for a technology to reduce the size and profile of a coil module in which the coil component 500 is mounted.

In addition, the surface-mount-type (SMD-type) coil component 500 illustrated in FIG. 17 has a structure that includes a resin insulating layer and in which a complete coil component (coil core 501, coil electrodes 502*a*, 502*b*) is molded in resin. Only external-connection terminals of the coil component 500, which are provided on a surface of the resin insulating layer, are electrically connected to the wiring substrate by using bonding material such as solder. Therefore, since the efficiency of conduction of heat from the coil component 500 to the wiring substrate is low, improving a heat dissipation property of the coil component 500 in order release heat generated by the coil of the coil component 500 to the wiring substrate has been a problem in the related art.

In order to improve the heat dissipation property of the coil component 500, forming the resin insulating layer, which has the coil built there into, out of a resin having high thermal conductivity may be considered. However, in this case, since a resin having high thermal conductivity is expensive compared with general molding-use resins such as epoxy resin, there is a risk of an increase in the manufacturing cost of the coil module. Therefore, a technology for improving a heat dissipation property of the coil module at low cost in order to release heat generated by a coil is demanded.

The present disclosure was made in light of the above-described problems and it is an object thereof to provide a technology that can reduce the size and profile of a coil module and can improve a heat dissipation property of a coil module at low cost.

In order to achieve this object, a coil module of the present disclosure that is equipped with a coil including a coil core and a coil electrode that is wound around the periphery of the coil core in a spiral shape, comprises: a wiring layer that is provided with a wiring electrode that includes a one-side coil electrode that forms part of the coil electrode; a resin insulating layer that is stacked on one main surface of the wiring layer, that has the coil core buried therein and that is provided with an other-side coil electrode that forms a remaining part of the coil electrode; a component that is provided on the wiring layer and is connected to the wiring electrode; and a plurality of columnar connection conductors that are buried in the resin insulating layer and that each have one end thereof exposed at one main surface, which is on the opposite side to the wiring layer, of the resin insulating layer as an external connection terminal and another end thereof connected to the wiring electrode of the wiring layer; wherein the coil electrode is formed by the other-side coil electrode of the resin insulating layer being connected to the one-side coil electrode of the wiring layer.

In the thus-configured disclosure, the resin insulating layer, in which the coil core is buried, is stacked on the one main surface of the wiring layer on which the wiring electrode is provided, and various components are provided in the wiring layer and connected to the wiring electrode. In addition, a plurality of columnar connection conductors are buried in the resin insulating layer together with the coil core, one ends of the connection conductors being exposed at the one main surface, which is on the opposite side to the wiring layer, of the resin insulating layer as external connection terminals and the other ends of the connection conductors being connected to the wiring electrode of the wiring layer. Furthermore, the wiring electrode of the wiring layer includes a one-side coil electrode that forms part of the coil electrode that forms the coil by being wound around the periphery of the coil core in a spiral shape, and an other-side coil electrode, which forms the remaining part of the coil electrode, is provided on the resin insulating layer. The coil electrode is formed by connecting the other-side coil electrode of the resin insulating layer to the one-side coil electrode of the wiring layer.

Thus, as a result of the one-side coil electrode, which forms part of the coil electrode, being provided on the wiring layer, reductions in the size and profile of the resin insulating layer, in which the coil core is buried, can be achieved. Therefore, reductions in the size and profile of the coil module can be achieved compared with a coil module of the related art in which a coil component, which has a complete coil product built into the inside thereof, is mounted on a wiring substrate. In addition, since the one-side coil electrode, which forms part of the coil electrode, is provided on the wiring layer, heat generated by the coil can be efficiently conducted to the wiring layer from the one-side coil electrode even when the resin insulating layer is formed of a typical thermally curable molding resin. Therefore, the heat dissipation property of the coil module can be improved at low cost.

In addition, a configuration may be adopted in which: the other-side coil electrode of the resin insulating layer includes a plurality of first columnar conductors that are buried in the resin insulating layer, that are arranged so as to intersect a direction of a central axis of the coil, that are arranged on one side of the coil core, that each have one end thereof exposed at the one main surface of the resin insulating layer and that each have another end thereof exposed at another main surface of the resin insulating layer, a plurality of second columnar conductors that are buried in the resin insulating layer, that are arranged so as to intersect the direction of the central axis of the coil, that are arranged on another side of the coil core such that the coil core is interposed between the plurality of second columnar conductors and the plurality of first columnar conductors, that each have one end thereof exposed at the one main surface of the resin insulating layer and that each have another end thereof exposed at the other main surface of the resin insulating layer, and a plurality of first connection members that are formed on the one main surface of the resin insulating layer and connect the one ends of pairs of the first columnar conductors and the second columnar conductors to each other; and the one-side coil electrode of the wiring layer includes a plurality of second connection members, each second connection member connecting the other end of a first columnar conductor and the other end of a second columnar conductor, which is adjacent to one side of the second columnar conductor that forms a pair with the first columnar conductor, to each other.

With this configuration, a plurality of first columnar conductors are arranged so as to intersect the direction of the central axis of the coil (direction of magnetic flux generated inside coil core), are arranged on one side of the coil core and are buried in the resin insulating layer. Furthermore, a plurality of second columnar conductors are arranged so as to intersect the direction of the central axis of the coil, are arranged on the other side of the coil core such that the coil core is interposed between the plurality of second columnar conductors and the plurality of first columnar conductors, and are buried in the resin insulating layer. In addition, the one ends of the first columnar conductors and the second columnar conductors are exposed at the one main surface of the resin insulating layer and the other ends of the first columnar conductors and the second columnar conductors are exposed at the other main surface of the resin insulating layer.

The other-side coil electrode of the resin insulating layer is formed by the one ends of pairs of the first columnar conductors and the second columnar conductors being connected to each other by a plurality of first connection members formed on the one main surface of the resin insulating layer. Therefore, a coil module that has a useful configuration can be provided in which the coil electrode is formed by connecting the other end of each first columnar conductor and the other end of a second columnar conductor, which is adjacent to one side of the second columnar conductor that forms a pair with the first columnar conductor, to each other with a corresponding one of the second connection members of the one-side coil electrode formed on the wiring layer.

Furthermore, a configuration may be adopted in which the coil includes the coil core, which has a toroidal shape, and the first columnar conductors are arranged along an outer peripheral surface of the coil core on an outside, which is the one side, of the core, and the second columnar conductors are arranged along an inner peripheral surface of the coil core on an inside, which is the other side, of the core.

In this configuration, the coil has a toroidal coil core, the first columnar conductors are arranged along the outer peripheral surface on the outside, which is the one side, of the coil core and the second columnar conductors are arranged along the inner peripheral surface on the inside, which is the other side, of the coil core. Therefore, the lines of magnetic force generated by the coil have a closed magnetic circuit structure in which the lines mainly pass through the ring-shaped coil core and consequently a coil module can be provided that has little leakage magnetic flux.

Furthermore, the connection conductors, the first columnar conductors and the second columnar conductors may be formed of metal pins.

In this configuration, the first and second columnar conductors that form wiring lines of the coil electrode in a direction (may be referred to as "columnar conductor direction") that intersects the direction of the central axis of the coil are formed of metal pins. Therefore, the wiring line length of the coil electrode in the columnar conductor direction can be easily increased by simply making the metal pins longer. Therefore, the thickness of the coil core in the columnar conductor direction can be easily increased.

In addition, since the first and second columnar conductors are formed of metal pins, the wiring lines of the coil electrode in the columnar conductor direction can be formed by simply arranging metal pins without the need to form a plurality of through holes in a core substrate such as a printed substrate or a pre-preg as in the case of through conductors or via conductors in order to form the wiring lines of the coil electrode in the columnar conductor direction. In addition, there is no risk of the thickness of the wiring lines of the coil electrode in the columnar conductor direction formed of metal pins changing, as in the case of through hole conductors and via conductors. Therefore, a coil module can be provided that includes a coil having a coil core of large thickness and having excellent inductance characteristics, and that can realize a reduction in the pitch of the coil electrode. Furthermore, the first and second columnar conductors of the resin insulating layer and the plurality of external-connection-use connection conductors of the coil module can be simultaneously formed by simply burying metal pins in the resin insulating layer without incurring a large increase in manufacturing cost.

In addition, at least either of the first columnar conductors and the second columnar conductors may include a connection-use columnar conductor, which is for realizing an external connection, and one end of the connection-use columnar conductor may be exposed at the one main surface of the resin insulating layer as an external connection terminal.

In this configuration, the external connection terminal, which is formed of the one end of the connection-use columnar conductor exposed at the one main surface of the resin insulating layer, can be connected to another substrate such as an external mother substrate, and thereby the coil of the coil module can be connected to the other substrate over the shortest distance. In addition, external connection terminals, which function as lead-out terminals that can lead out a signal from an arbitrary position along the coil electrode, can be easily formed by configuring arbitrary columnar conductors among the first and second columnar conductors as connection-use columnar conductors.

In addition, a configuration may be adopted in which at least two of the connection-use columnar conductors are included, one end of the coil electrode is connected to one of the connection-use columnar conductors, another end of the coil electrode is connected to another of the connection-use columnar conductors, and the coil electrode and the component are not electrically connected to each other.

In this configuration, input/output terminals of the coil can be simply formed of external connection terminals that are formed of the one end of the one connection-use columnar conductor that is connected to the one end of the coil electrode and the other connection-use columnar conductor that is connected to the other end of the coil electrode. Furthermore, since the coil and the other component of the coil module are not electrically connected to each other, the coil of coil module can be connected to another substrate over the shortest distance in a state where the coil and the other component of the coil module are electrically isolated from each other by using the input/output terminals formed by the connection-use columnar conductors.

One end of the coil electrode may be connected to one of the connection conductors via the wiring electrode of the wiring layer and another end of the coil electrode may be connected to another of the connection conductors via the wiring electrode of the wiring layer.

Therefore, a coil module is provided that has a useful configuration in which input/output terminals of the coil are formed of external connection terminals formed by one end of the one connection conductor, which is connected to the one end of the coil electrode, and one end of the other connection conductor, which is connected to the other end of the coil electrode.

In addition, the wiring electrode of the wiring layer may include a planar shielding electrode that is provided between the coil electrode and the component.

In this configuration, since the planar shielding electrode is provided between the coil electrode and the component, the coil can be prevented from affecting the component mounted in the coil module.

In addition, a shield layer may be provided on the one main surface of the resin insulating layer.

In this configuration, since the shield layer is arranged between the coil of the coil module and another substrate on which the coil module is mounted, the coil mounted in the coil module can be prevented from affecting the other substrate.

In addition, a configuration may be adopted in which the coil electrode includes a primary-side electrode group that forms a primary coil of a transformer and a secondary-side electrode group that forms a secondary coil of the transformer, and the primary-side electrode group and a component that is connected to the primary-side electrode group are arranged in one region partitioned by a prescribed boundary line in plan view, and the secondary-side electrode group and a component that is connected to the secondary-side electrode group are arranged in another region partitioned by the prescribed boundary line in plan view.

In this configuration, a coil module can be provided that has a useful configuration in which the component on the primary-coil side of the transformer and the component on the secondary-coil side of the transformer are arranged so as to be isolated from each other with the boundary line interposed therebetween.

In addition, a configuration may be adopted in which another coil is further arranged on another main surface of the wiring layer, and a thickness of the coil core of the coil arranged on the one main surface of the wiring layer and a thickness of a coil core of the other coil arranged on the other main surface of the wiring layer are different from each other.

In this configuration, an increase in the size of the coil module 1 can be prevented by respectively arranging coils of different heights on the two main surfaces of the wiring layer.

According to the present disclosure, the one-side coil electrode, which forms part of the coil electrode that forms the coil of the coil module, is provided on the wiring layer, and therefore reductions in the size and profile of the resin insulating layer in which the coil core is buried can be achieved compared with a coil component of the related art having a complete coil product built into the inside thereof. Therefore, reductions in the size and profile of a coil module can be achieved compared with a coil module of the related art which is formed by mounting a coil component on a wiring substrate. In addition, since the one-side coil electrode, which forms part of the coil electrode, is provided on the wiring layer, heat generated by the coil can be efficiently released to the wiring layer from the one-side coil electrode even when the resin insulating layer is formed of a typical thermally curable molding resin. Therefore, the heat dissipation property of the coil module can be improved at low cost.

BRIEF DESCRIPTION OF THE SEVERAL VIEWS OF THE DRAWINGS

Each of FIGS. 3A to 3D is a partial sectional view illustrating an example of a method of manufacturing the coil module of FIG. 1, where.

Each of FIGS. 5A to 5E is a partial sectional view illustrating an example of a method of manufacturing the coil module of FIG. 4, where.

Each of FIGS. 16A and 16B illustrates modifications of the coil core, where.

DETAILED DESCRIPTION OF THE DISCLOSURE

First Embodiment

A coil module according to a first embodiment of the present disclosure will be described.

(Outline Configuration of Coil Module)

Figure 1:
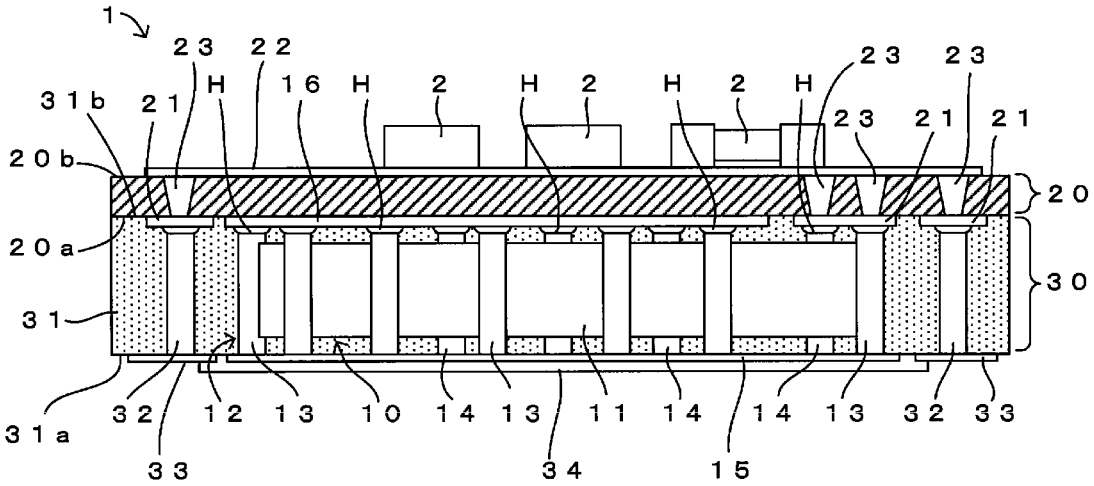
FIG. 1 is a partial sectional view illustrating a coil module according to a first embodiment of the present disclosure.
Figure 2:
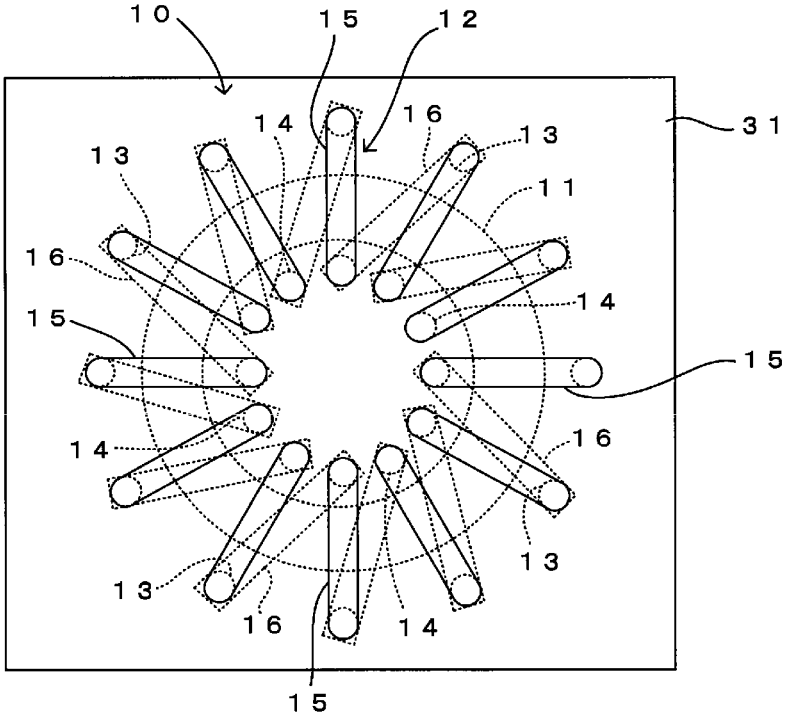
FIG. 2 is a drawing for explaining the connection states of columnar conductors that form coil electrodes.

An outline configuration of a coil module 1 will be described while referring to FIGS. 1 and 2. FIG. 1 is a partial sectional view illustrating the coil module according to the first embodiment of the present disclosure. In addition, FIG. 2 is a drawing for explaining the connection states of columnar conductors that form coil electrodes of a coil of the coil module of FIG. 1 and illustrates a state in which the coil module of FIG. 1 is seen from below the plane of the paper. In the drawings including FIGS. 1 and 2 referred to in the following description, the configurations of the electrodes and so forth are drawn in a schematic manner and illustration of some of the columnar conductors and connection conductors is omitted in order to simplify the description, and detailed description thereof is omitted in the following description.

As illustrated in FIGS. 1 and 2, the coil module 1 is a module that includes a coil 10. The coil 10 includes a coil core 11 and a coil electrode 12 that is wound around the periphery of the coil core 11 in a spiral shape. The coil module 1 includes a wiring substrate 20, a coil component 30 that is arranged at a prescribed position on one main surface 20*a* of the wiring substrate 20, and circuit components 2 that are mounted on another main surface 20*b* of the wiring substrate 20. The coil module 1, which has various functions, is formed by mounting the circuit components 2 such as chip components including chip inductors, chip capacitors and chip resistors, and functional components such as high-frequency filters, high-frequency switch ICs, RF-ICs and power supply switching elements such as FETs, on the other main surface 20*b* of the wiring substrate 20 as "components" of the present disclosure as needed. In addition, in this embodiment, the coil 10 includes the coil core 11, which has a ring-like toroidal shape.

The wiring substrate 20 (corresponding to a "wiring layer" of the present disclosure) includes a plurality of external-connection-use land electrodes 21 and a plurality of line-shaped substrate-side wiring electrode patterns 16, which form part of the coil electrode 12, that are formed on the one main surface 20*a*. The wiring substrate 20 includes a plurality of land electrodes 22 that are formed on the other main surface 20*b* and that have the circuit components 2 mounted thereon and connected thereto. The land electrodes 21 on the one main surface 20*a* and the land electrodes 22 on the other main surface 20*b* are connected to each other by internal wiring electrodes 23 such as interlayer connection conductors (via conductors) and in-plane conductors that are formed inside the wiring substrate 20. In addition, the wiring substrate 20 can be formed of a resin multilayer substrate, which uses a resin or a polymer material, a printed substrate, an LTCC, an alumina-based substrate, a glass substrate, a composite material substrate, a single-layer substrate, a multilayer substrate or the like, and the wiring substrate 20 is preferably formed by selecting the optimum material in accordance with the intended use of the coil module 1.

As described above, the land electrodes 21 and 22, the internal wiring electrodes 23 and the substrate-side wiring electrode patterns 16 are formed as a "wiring electrode" of the present disclosure.

The coil component 30 includes a single-layer resin insulating layer 31 in which the coil core 11 is buried. The resin insulating layer 31 is stacked on the one main surface 20*a* of the wiring substrate 20. In addition, a plurality of first columnar conductors 13, which are formed of metal pins, a plurality of second columnar conductors 14, which are formed of metal pins, and a plurality of line-shaped component-side wiring electrode patterns 15, are provided in the resin insulating layer 31. The first columnar conductors 13, the second columnar conductors 14 and the component-side wiring electrode patterns 15 form a part of the coil electrode 12. In addition, a plurality of external-connection-use columnar connection conductors 32, which are formed of metal pins, are buried in the resin insulating layer 31. Furthermore, external-bonding-use mounting electrodes 33 and a resin protective layer 34 are provided on one main surface 31*a* of the resin insulating layer 31.

The resin insulating layer 31 is formed of a typical resin used for resin sealing (molding) such as thermally curable epoxy resin. The coil core 11 is formed of a magnetic material that is typically used for a coil core such as ferrite or iron. The resin insulating layer 31 may be formed of a plurality of layers composed of the same resin or different resins.

The first columnar conductors 13 are buried in the resin insulating layer 31, are arranged so as be substantially orthogonal to the direction of a central axis of the coil 10, and are arranged along an outer peripheral surface of the coil core 11 on the outside, which is one side, of the coil core 11. The term "direction of the central axis of the coil" in the present disclosure refers to the direction of magnetic flux (magnetic field) generated inside the ring-shaped coil core 11. A ring-shaped coil core 11 is used in the first embodiment and the magnetic flux is generated so as to rotate in a circumferential direction of the coil core 11. In addition, one end of each first columnar conductor 13 is exposed at the one main surface 31*a* of the resin insulating layer 31, which is on the opposite side to the wiring substrate 20, and the other end of each first columnar conductor 13 is exposed at another main surface 31*b* of the resin insulating layer 31.

The second columnar conductors 14 are buried in the resin insulating layer 31, are arranged so as to be substantially orthogonal to the direction of the central axis of the coil 10, and are arranged along an inner peripheral surface of the coil core 11 on the inside, which is the other side, of the coil core 11. In addition, one end of each second columnar conductor 14 is exposed at the one main surface 31*a* of the resin insulating layer 31 and the other end of each second columnar conductor 14 is exposed at the other main surface 31*b* of the resin insulating layer 31. At least either of the first columnar conductors 13 and the second columnar conductors 14 may be arranged so as to intersect the direction of the central axis of the coil 10, and for example, be arranged so as to be inclined with respect to a direction that is orthogonal to the direction of the central axis.

The component-side wiring electrode patterns 15 are formed on the one main surface 31*a* of the resin insulating layer 31 and are connected to the one ends of the columnar conductors 13 and 14, which are exposed at the one main surface 31*a* of the resin insulating layer 31. The one ends of each pair of a first columnar conductor 13 and a second columnar conductor 14 are connected to each other by a corresponding component-side wiring electrode pattern 15.

In addition, the other ends of the first and second columnar conductors 13 and 14, which are exposed at the other main surface 31*b* of the resin insulating layer 31, are connected to each other as follows by the substrate-side wiring electrode patterns 16 by using a bonding material H such as solder. That is, the other end of each first columnar conductor 13 and the other end of a second columnar conductor 14, which is adjacent to one side (counterclockwise direction in FIG. 2 in this embodiment) of the second columnar conductor 14 that forms a pair with the first columnar conductor 13, are connected to each other by a corresponding substrate-side wiring electrode pattern 16. Thus, the coil electrode 12, which is wound around the periphery of the coil core 11 in a spiral shape, is formed by connecting the columnar conductors 13 and 14 and the component-side wiring electrode patterns 15, which are provided in the coil component 30, to the substrate-side wiring electrode patterns 16, which are provided on the one main surface 20*a* of the wiring substrate 20.

In addition, as illustrated in FIGS. 1 and 2, among the columnar conductors 13 and 14, the other ends of columnar conductors 13 and 14 that are not connected to substrate-side wiring electrode patterns 16 are used as signal lead-out terminals by being connected to the land electrodes 21 formed on the one main surface 20*a* of the wiring substrate 20 using the bonding material H such as solder and being thereby connected to the mounting electrodes 33 formed on the one main surface 31*a* of the resin insulating layer 31 via the internal wiring electrodes 23 and the connection conductors 32 and so forth. That is, one end of the coil electrode 12 is connected to a mounting electrode 33 by being connected to a connection conductor 32 via a wiring electrode of the wiring substrate 20, and the other end of the coil electrode 12 is connected to a mounting electrode 33 by being connected to another connection conductor 32 via a wiring electrode of the wiring substrate 20.

As described above, in this embodiment, the columnar conductors 13 and 14 and the component-side wiring electrode patterns 15 are formed as an "other-side coil electrode" of the present disclosure, and the component-side wiring electrode patterns 15 are formed as "first connection members" of the present disclosure. In addition, the substrate-side wiring electrode patterns 16 are formed as a "one-side coil electrode" and "second connection members" of the present disclosure.

Furthermore, one ends of the connection conductors 32 are exposed at the one main surface 31*a* of the resin insulating layer 31 and are connected to the mounting electrodes 33 as external connection electrodes and the other ends of the connection conductors 32 are exposed at the other main surface 31*b* of the resin insulating layer 31 and connected to the land electrodes 21 formed on the one main surface 20*a* of the wiring substrate 20 using the bonding material H such as solder. Thus, the wiring substrate 20 (circuit components 2 and coil 10) is connected to the outside via the connection conductors 32 and the mounting electrodes 33.

The columnar conductors 13 and 14 and the connection conductors 32 are formed of a metal material that is typically used for wiring electrodes such as Cu, Au, Ag, Al or an alloy of any of these metals. In addition, the columnar conductors 13 and 14 and the connection conductors 32 may be formed of pin-shaped members that have been plated with Cu or Ni. The columnar conductors 13 and 14 and the connection conductors 32 may have a rectangular or polygonal sectional shape in a longitudinal direction thereof.

In addition, the wiring electrode patterns 15 and 16 are formed by etching metal foils (films) using photolithography or a resist film or are formed by applying a conductive paste containing Cu, Au or Ag using screen printing. In addition, plating may be applied to the patterns formed by screen printing. In addition, the method of connecting corresponding one ends of the columnar conductors 13 and 14 to each other is not limited to the above-described examples, and for example, corresponding one ends of the columnar conductors 13 and 14 may be connected to each other using a wire bonding process by using bonding wires as the first connection members.

Furthermore, the first columnar conductors 13, which are arranged outside the coil core 11, may be formed so as to have a larger diameter than the second columnar conductors 14, which are arranged inside the coil core 11. When it is desired to increase the number of turns of the coil 10 in order to increase the inductance of the coil 10, since the space in which to arrange the columnar conductors 14 inside the ring-shaped coil core 11 is limited, the number of turns of the coil 10 can be increased by decreasing the cross-sectional area of the columnar conductors 14 by decreasing the diameter of the columnar conductors 14. In addition, although there is a risk of the coil characteristics being degraded due to the increase in the resistance value of the columnar conductors 14 caused by reducing the diameter of the columnar conductors 14, an increase in the resistance value of the coil electrode 12 as a whole can be suppressed by making the diameter of the columnar conductors 13 arranged outside the coil core 11, where there is plenty of space, larger than that of the columnar conductors 14.

In addition, when the first columnar conductors 13 and the second columnar conductors 14 have different diameters from each other, the wiring electrode patterns 15 and 16 may be formed so as to realize impedance matching between the first columnar conductors 13 and the second columnar conductors 14 having different diameters. For example, impedance matching can be realized between the columnar conductors 13 and 14 by forming the wiring electrode patterns 15 and 16 so as to have a tapered shape that becomes narrower from the larger-diameter first columnar conductor 13 toward the smaller-diameter second columnar conductor 14.

(Method of Manufacturing Coil Module)

An example of a method of manufacturing the coil module 1 will be described while referring to FIGS. 3A to 3D. Each of FIGS. 3A to 3D is a partial sectional view illustrating an example of a method of manufacturing the coil module of FIG. 1, where FIG. 3A illustrates a state in which the columnar conductors and connection conductors have been mounted on the wiring substrate, FIG. 3B illustrates a state in which the coil core has been arranged, FIG. 3C illustrates a state in which the resin insulating layer of the coil component has been formed and FIG. 3D illustrates a state in which the coil component has been completed.

Figure 3A:
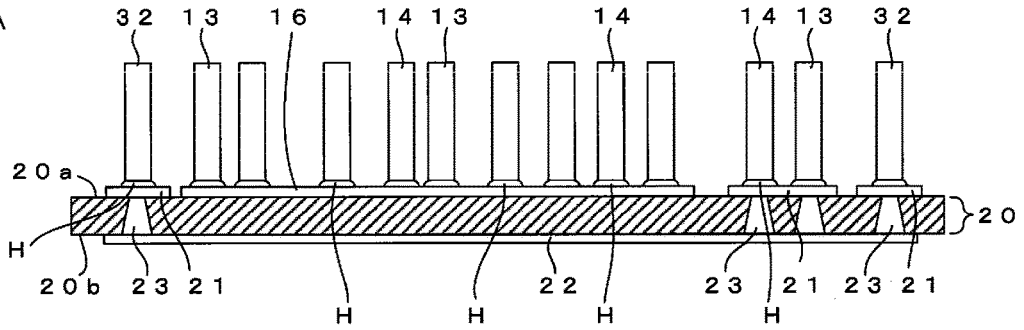
FIG. 3A illustrates a state in which columnar conductors and connection conductors have been mounted on a wiring substrate.
Figure 3B:
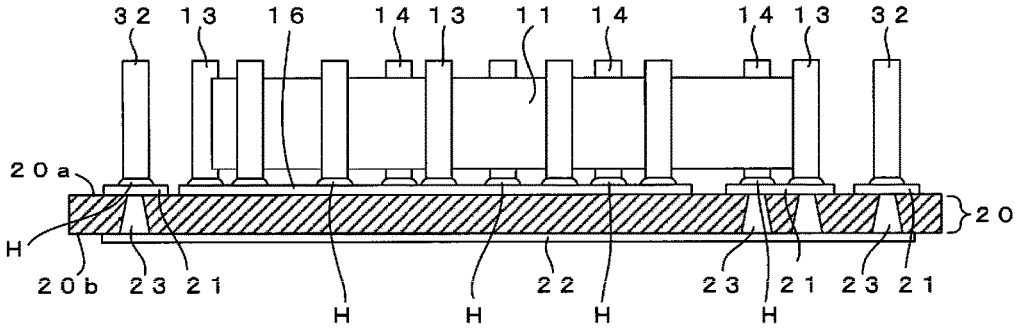
FIG. 3B illustrates a state in which a coil core has been arranged.
Figure 3C:
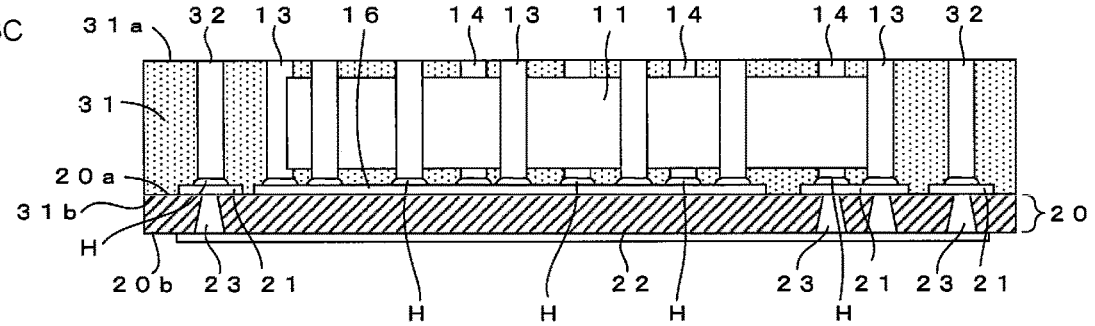
FIG. 3C illustrates a state in which a resin insulating layer of a coil component has been formed and FIG. 3D illustrates a state in which the coil component has been completed.
Figure 3D:
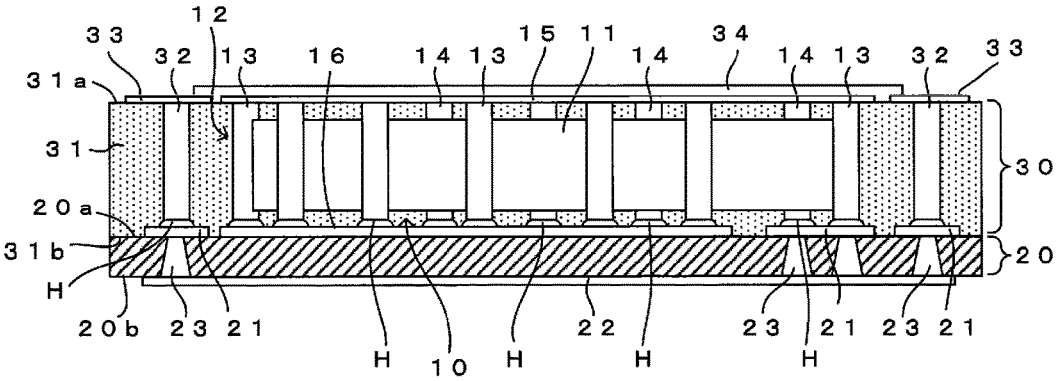

First, as illustrated in FIG. 3A, the wiring substrate 20 is prepared on which the land electrodes 21 and 22 and the substrate-side wiring electrode patterns 16 have been formed at prescribed positions on the two main surfaces 20*a* and 20*b* thereof and in which the internal wiring electrodes 23 have been provided. Next, the other ends of the first and second columnar conductors 13 and 14 are connected at prescribed positions on the substrate-side wiring electrode patterns 16 on the one main surface 20*a* of the wiring substrate 20 using the bonding material H such as solder. In addition, the other ends of the connection conductors 32 are connected to the land electrodes 21 on the one main surface 20*a* of the wiring substrate 20 using the bonding material H such as solder. Thus, the first and second columnar conductors 13 and 14, which form part of the coil electrode 12, and the external-connection-use connection conductors 32 can be simultaneously arranged on the one main surface 20*a* of the wiring substrate 20 in one go.

In addition, in order to prevent contact between the coil core 11 and the substrate-side wiring electrode patterns 16, a solder resist layer may be arranged in parts other than at the connection positions of the columnar conductors 13 and 14 and the land electrodes 21 and may be arranged in parts where the coil core 11 is arranged.

The columnar conductors 13 and 14 are connected to the substrate-side wiring electrode patterns 16, and as a result, the other end of each first columnar conductor 13 and the other end of a second columnar conductor 14, which is adjacent to one side of the second columnar conductor 14 that forms a pair with the first columnar conductor 13, are connected to each other by the corresponding substrate-side wiring electrode pattern 16. In addition, the other ends of the columnar conductors 13 and 14, which are not connected to the substrate-side wiring electrode patterns 16 and are for leading out a signal, are connected to the land electrodes 21.

Next, as illustrated in FIG. 3B, the coil core 11 is arranged in a ring-shaped region on the one main surface 20*a* of the wiring substrate 20 that is interposed between the first columnar conductors 13, which are outside the coil core 11, and the second columnar conductors 14, which are inside the coil core 11. Therefore, the first columnar conductors 13 are arranged so as to be substantially orthogonal to the direction of the central axis of the coil 10 and are arranged along the outer peripheral surface, which is on the outside, of the coil core 11, and the second columnar conductors 14 are arranged so as to be substantially orthogonal to the direction of the central axis of the coil 10 and are arranged along the inner peripheral surface, which is on the inside, of the coil core 11. Thus, the first columnar conductors 13 and the second columnar conductors 14 are arranged so as to face each other with the coil core 11 interposed therebetween.

Next, as illustrated in FIG. 3C, the resin insulating layer 31 is formed by resin sealing the coil core 11, the columnar conductors 13 and 14 and the connection conductors 32 by using a typical thermally curable molding resin such as epoxy resin. Next, as illustrated in the same figure, resin is removed from the one main surface 31*a* of the resin insulating layer 31 by polishing or grinding so as to expose the one ends of the columnar conductors 13 and 14 and the connection conductors 32.

Next, as illustrated in FIG. 3D, a plurality of the component-side wiring electrode patterns 15 are formed so as to connect the one ends, which are exposed at the one main surface 31*a* of the resin insulating layer 31, of the pairs of first and second columnar conductors 13 and 14. In addition, the mounting electrodes 33, which are for realizing external connections, are formed so as to be connected to the one ends of the connection conductors 32 exposed at the one main surface 31*a* of the resin insulating layer 31. Furthermore, the resin protective layer 34, which is for protecting the component-side wiring electrode patterns 15 and the mounting electrodes 33, is formed on the one main surface 31*a* of the resin insulating layer 31. Then, as illustrated in FIG. 1, the coil module 1 is completed by mounting prescribed circuit components 2 on the other main surface 20*b* of the wiring substrate 20.

In the step of removing resin from the one main surface 31*a* of the resin insulating layer 31, resin may be removed from the one main surface 31*a* of the resin insulating layer 31 such that the one ends of the columnar conductors 13 and 14 and the connection conductors 32 are exposed so as to protrude somewhat from the one main surface 31*a* of the resin insulating layer 31. In addition, for example, the one ends of the columnar conductors 13 and 14 and the connection conductors 32 can be exposed so as to protrude from the resin insulating layer 31 by polishing the one main surface 31*a* of the resin insulating layer 31 using an abrasive agent composed of a material that is softer than the columnar conductors 13 and 14 and the connection conductors 32 but harder than the resin insulating layer 31.

Furthermore, a resin layer may be additionally provided that covers the circuit components 2 provided on the other main surface 20*b* of the wiring substrate 20.

As described above, in this embodiment, the single-layer resin insulating layer 31, in which the coil core 11 is buried, is stacked on the one main surface 20*a* of the wiring substrate 20 in which wiring electrodes (land electrodes 21 and 22, internal wiring electrodes 23 and substrate-side wiring electrode patterns 16) are provided, and various circuit components 2 are provided on the wiring substrate 20 by being connected to the land electrodes 22 (wiring electrodes). In addition, the plurality of columnar connection conductors 32 are buried in the resin insulating layer 31 along with the coil core 11, the one ends of the connection conductors 32 being exposed at the one main surface 31*a* of the resin insulating layer 31 as external connection terminals and the other ends of the connection conductors 32 being connected to the land electrodes (wiring electrodes) of the wiring substrate 20. In addition, the wiring electrodes of the wiring substrate 20 include the substrate-side wiring electrode patterns 16 that form part of the coil electrode 12 that forms the coil 10 by being wound around the periphery of the coil core 11 in a spiral shape, and the first and second columnar conductors 13 and 14 and the component-side wiring electrode patterns 15, which form the remaining part of the coil electrode 12, are provided in the resin insulating layer 31. The coil electrode 12 is formed by the first and second columnar conductors 13 and 14 and the component-side wiring electrode patterns 15 of the resin insulating layer 31 being connected to the substrate-side wiring electrode patterns 16 of the wiring substrate 20.

Figure 17:
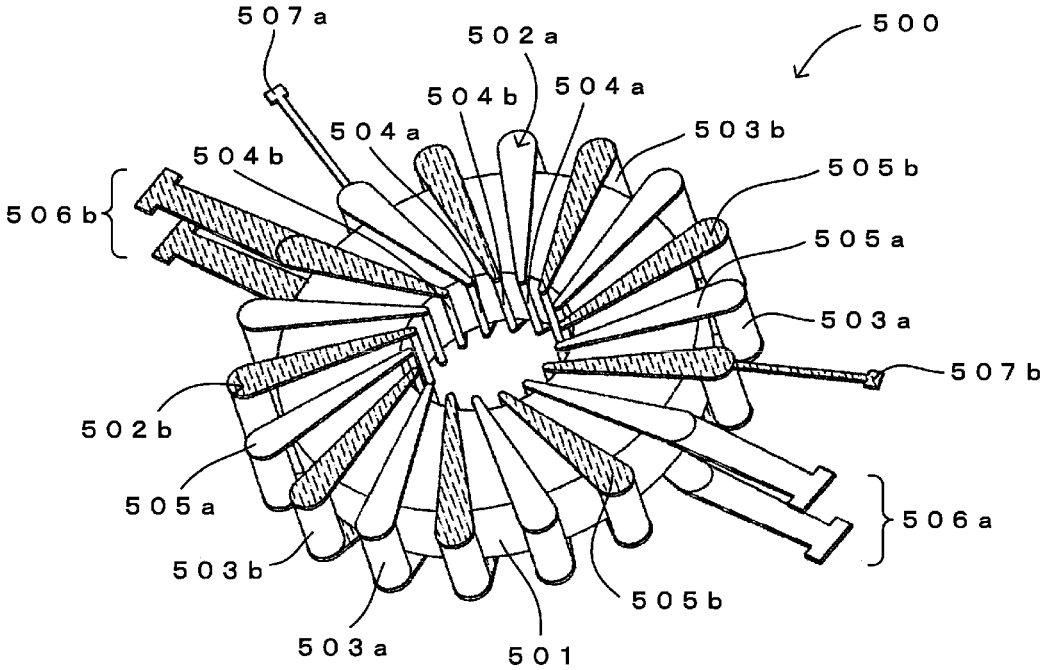
FIG. 17 illustrates an example of a coil component of the related art.

Thus, as a result of the substrate-side wiring electrode patterns 16, which form a part of the coil electrode 12, being provided on the wiring substrate 20, reductions in the size and profile of the resin insulating layer 31, in which the coil core 11 is buried, can be achieved. Therefore, reductions in the size and profile of the coil module 1 can be achieved compared with the coil module of the related art in which the coil component 500, which has a complete coil product built into the inside thereof, is mounted on a wiring substrate, as illustrated in FIG. 17. In addition, since the substrate-side wiring electrode patterns 16, which form a part of the coil electrode 12, are provided on the wiring substrate 20, heat generated by the coil 10 can be efficiently conducted to the wiring substrate 20 from the substrate-side wiring electrode patterns 16 despite the resin insulating layer 31 being formed of a typical thermally curable molding resin. Therefore, the heat dissipation property of the coil module 1 can be improved at low cost. Furthermore, compared with the configuration of the related art in which only the external-connection-use terminals provided on the surface of the resin insulating layer of the coil component are electrically connected to the wiring substrate by using a bonding material such as solder, the strength of the connections between the wiring substrate 20 and the coil component 30 can be improved as a result of the substrate-side wiring electrode patterns 16, which form a part of the coil electrode 12, being provided on the wiring substrate 20.

Incidentally, the inductance characteristics of the coil 10 depend on the volume of the magnetic body (coil core 11). Therefore, if the surface-mount coil component 500 of the related art illustrated in FIG. 17 were mounted on the surface of the wiring substrate 20, the following would be necessary in order to improve the inductance characteristics of the coil built into the coil component 500 while maintaining the surface area (size) of the wiring substrate 20 at a fixed size. That is, since other surface-mount circuit components 2 also need to be mounted on the surface of the wiring substrate 20, there is limited space in which to arrange the coil component 500 on the surface of the wiring substrate 20. Therefore, in order to improve the inductance characteristics of the coil built into the coil component 500, it would be necessary to increase the volume of the magnetic body by increasing the height of the coil core 501. Consequently, increasing the height of the coil component 500 would inhibit reducing the profile of the coil module.

On the other hand, by forming the substrate-side wiring electrode patterns 16, which form a part of the coil electrode 12, on the wiring substrate 20 and forming the coil 10 by integrating the coil component 30 with the wiring substrate 20 as in the above-described coil module 1, substantially the entirety of the region inside the resin insulating layer 31 can be allocated as a space in which to form the coil 10 as needed. Therefore, the volume of the coil core 11 can be maintained at a prescribed size or higher even when the thickness of the coil core 11 is reduced by increasing the arrangement space of the coil core 11 in plan view. Therefore, the profile of the coil module 1 can be reduced by reducing the thickness of the coil core 11, thereby reducing the thickness of the coil component 30.

Furthermore, surface-mount coil components of the related art are often customized products (custom products), particularly when mounted in a power (power supply) module. Therefore, a special mold and so forth has to be formed to manufacture the coil component and an increase in manufacturing cost is incurred. However, since the coil component 30 is provided with the other-side coil electrode (first and second columnar conductors 13 and 14 and component-side wiring electrode patterns 15) that form a part of the coil electrode 12 and not all of the coil electrode 12 is provided in the coil component 30 in the above-described coil module 1, the cost of the coil component 30 can be reduced by simplifying the manufacturing process compared with the coil component 500 of the related art illustrated in FIG. 17 that includes a complete coil product. In addition, in contrast to the configuration of the related art, the one-side coil electrode (substrate-side wiring electrode patterns 16), which forms the remaining part of the coil electrode 12, is provided on the wiring substrate 20. Consequently, it is possible to form the one-side coil electrode together with other wiring electrodes (land electrodes 21 and 22 and internal wiring electrodes 23) when forming the wiring substrate 20 using typical substrate forming techniques. Therefore, since there is no need for a special process for forming the one-side coil electrode, an increase in the cost of manufacturing the wiring substrate 20 can be suppressed.

Furthermore, compared with a configuration in which wiring electrode patterns are formed on both the main surfaces 31*a* and 31*b* of the resin insulating layer 31, in which the coil core 11 is buried, using typical wiring electrode pattern forming techniques as in the related art, the substrate-side wiring electrode patterns 16, which form a part of the coil electrode 12, can be formed on the wiring substrate 20 at very low cost using typical substrate forming techniques. Therefore, the coil electrode 12 is formed by connecting the other-side coil electrode and the one-side coil electrode to each other by arranging the coil component 30 on the wiring substrate 20, and as a result, the coil module 1 equipped with the coil 10 can be manufactured at a low cost.

Furthermore, a coil module 1 can be provided that has a useful configuration equipped with various functions by mounting chip components such as chip inductors, chip capacitors and chip resistors and functional components such as high-frequency filters, high-frequency switching ICs, RF-ICs and power supply switching elements such as FETs on the other main surface 20*b* of the wiring substrate 20 as the circuit components 2. In the above-described embodiment, although the circuit components 2 are only mounted on the other main surface 20*b* of the wiring substrate 20, the circuit components 2 may be mounted on the one main surface 20*a* of the wiring substrate 20 and buried in the resin insulating layer 31, or the circuit components 2 may be built into the wiring substrate 20 in accordance with the configuration required for the coil module 1.

In addition, the plurality of connection conductors 32, which are for connecting the wiring substrate 20 to the outside, are buried in the resin insulating layer 31 of the coil component 30. Therefore, the other-side coil electrode of the coil component 30 and the plurality of external-connection-use connection conductors 32 of the coil module 1 can be formed simultaneously when forming the coil component 30 without a large increase in manufacturing cost. Therefore, the coil module 1 can be easily connected to the outside through the one ends of the connection conductors 32, which function as external connection terminals, by simply arranging the coil component 30, which is provided with the plurality of external-connection-use connection conductors 32, on the wiring substrate 20. Therefore, the process of forming the external-connection-use connection terminals can be simplified and therefore the cost of manufacturing the coil module 1 can be reduced.

In addition, the plurality of first columnar conductors 13 are arranged so as to intersect the direction of the central axis of the coil 10, are arranged on the outside, which is one side, of the coil core 11 and are buried in the resin insulating layer 31. Furthermore, the plurality of second columnar conductors 14 are arranged so as to intersect the direction of the central axis of the coil 10, are arranged on the inside, which is the other side, of the coil core 11 such that the coil core 11 is interposed between the plurality of second columnar conductors 14 and the plurality of first columnar conductors 13, and are buried in the resin insulating layer 31. In addition, the one ends of the first columnar conductors 13 and the second columnar conductors 14 are exposed at the one main surface 31*a* of the resin insulating layer 31, which is on the opposite side to the wiring substrate 20 on which the substrate-side wiring electrode patterns 16 are formed, and the other ends of the first columnar conductors 13 and the second columnar conductors 14 are exposed at the other main surface 31*b* of the resin insulating layer 31.

The other-side coil electrode is formed by connecting the one ends of the pairs of first columnar conductors 13 and second columnar conductors 14 to each other with the plurality of component-side wiring electrode patterns 15 formed on the one main surface 31*a* of the resin insulating layer 31. Therefore, the coil module 1 can be provided that has a useful configuration in which the coil electrode 12 is formed by connecting the other end of each first columnar conductor 13 and the other end of a second columnar conductor 14, which is adjacent to one side of the second columnar conductor 14 that forms a pair with the first columnar conductor 13, to each other with a corresponding substrate-side wiring electrode pattern 16 formed as part of the one-side coil electrode on the one main surface 20*a* of the wiring substrate 20.

In addition, the coil 10 has a toroidal coil core 11, the first columnar conductors 13 are arranged along the outer peripheral surface on the outside, which is the one side, of the coil core 11 and the second columnar conductors 14 are arranged along the inner peripheral surface on the inside, which is the other side, of the coil core 11. Therefore, the coil module 1 can be provided that has little leakage magnetic flux since the magnetic flux generated by the coil 10 has a closed magnetic circuit structure in which the magnetic flux mainly passes through the ring-shaped coil core 11.

Furthermore, the connection conductors 32 and the first and second columnar conductors 13 and 14, which form wiring lines of the coil electrode 12 in a direction that intersects the direction of the center axis of the coil 10, are formed of metal pins. Therefore, the wiring line length of the coil electrode 12 in the direction of the columnar conductors can be easily increased by simply making the metal pins longer. Therefore, the thickness of the coil core 11 in the direction of the columnar conductors can be easily increased.

In addition, since the first and second columnar conductors 13 and 14 are formed of metal pins, the wiring lines of the coil electrode 12 in the direction of the columnar conductors can be formed by simply arranging metal pins without the need to form a plurality of through holes in a core substrate such as a printed substrate or a pre-preg as in the case of through conductors or via conductors in order to form the wiring lines of the coil electrode 12 in the direction of the columnar conductors. In addition, there is no risk of changes occurring in the thickness of the wiring lines of the coil electrode 12 in the direction of the columnar conductors formed of metal pins, like in the case of through hole conductors and via conductors. Therefore, the coil module 1 can be provided that includes a coil, in which the coil core 11 has a large thickness and that has excellent inductance characteristics, and that can realize a reduction in the pitch of the coil electrode 12. Furthermore, the first and second columnar conductors 13 and 14 of the resin insulating layer 31 and the plurality of external-connection-use connection conductors 32 of the coil module can be simultaneously formed by simply burying metal pins in the resin insulating layer 31 without incurring a large increase in manufacturing cost.

In addition, one end of the coil electrode 12 is connected to one connection conductor 32 via a wiring electrode of the wiring substrate 20 and the other end of the coil electrode 12 is connected to another connection conductor 32 via a wiring electrode of the wiring substrate 20. Therefore, the coil module 1 is provided that has a useful configuration in which input/output terminals of the coil 10 are formed of external connection terminals formed by one end of the one connection conductor 32, which is connected to the one end of the coil electrode 12, and one end of the other connection conductor 32, which is connected to the other end of the coil electrode 12.

Second Embodiment

A coil module according to a second embodiment of the present disclosure will be described while referring to FIGS. 4 and 5A to 5E.

Figure 4:
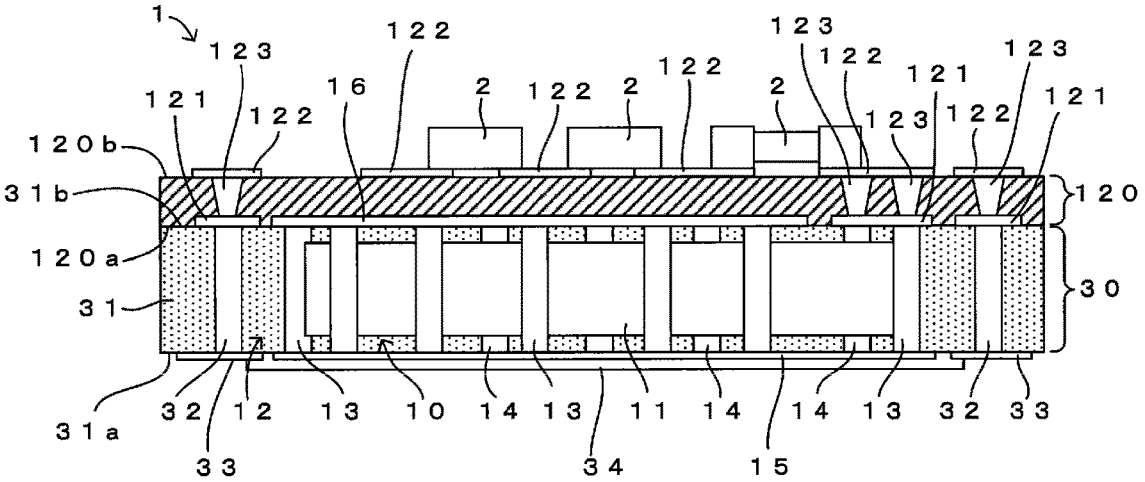
FIG. 4 is a partial sectional view illustrating a coil module according to a second embodiment of the present disclosure.
Figure 5A:
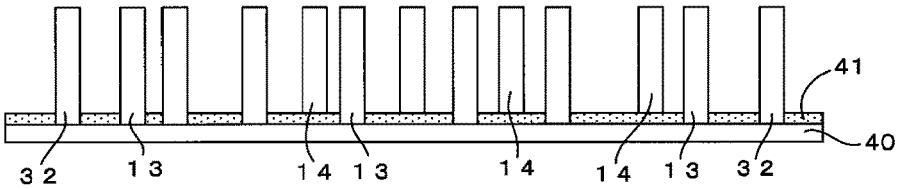
FIG. 5A illustrates a state in which columnar conductors and connection conductors have been arranged on a release sheet.
Figure 5B:
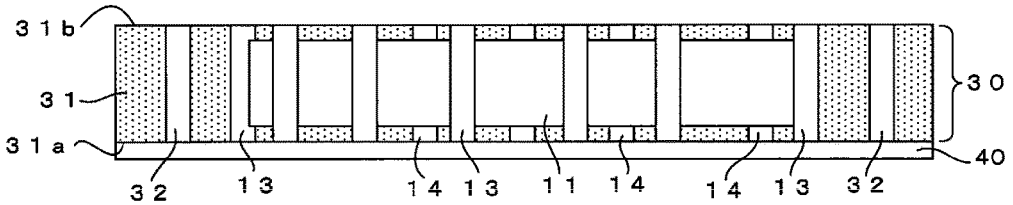
FIG. 5B illustrates a state in which a coil core of a coil component has been arranged and a resin insulating layer has been formed.
Figure 5C:
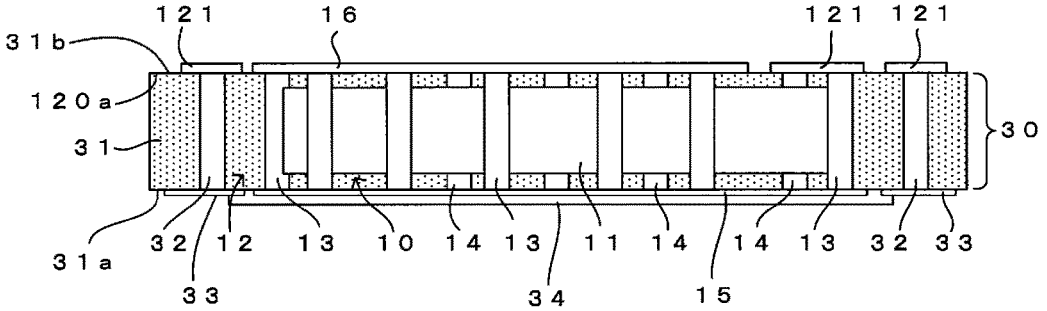
FIG. 5C illustrates a state in which electrodes have been formed on the resin insulating layer.
Figure 5D:
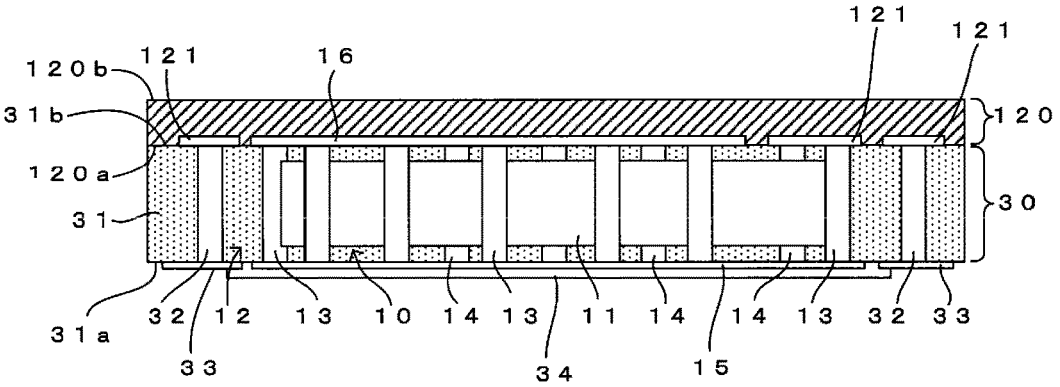
FIG. 5D illustrates a state in which a wiring layer has been formed and FIG. 5E illustrates a state in which wiring electrodes have been formed on the wiring layer.
Figure 5E:
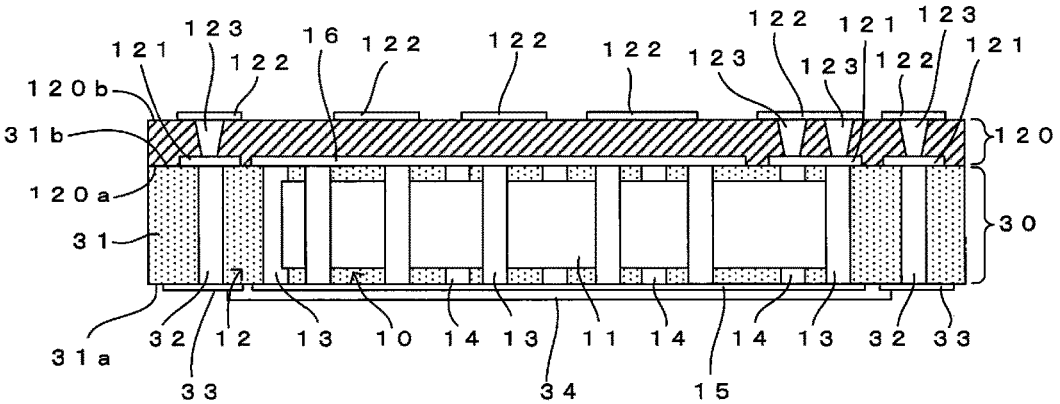

FIG. 4 is a partial sectional view illustrating the coil module according to the second embodiment of the present disclosure. In addition, Each of FIGS. 5A to 5E is a partial sectional view illustrating an example of a method of manufacturing the coil module of FIG. 4, where FIG. 5A illustrates a state in which columnar conductors and connection conductors have been arranged on a release sheet, FIG. 5B illustrates a state in which a coil core of a coil component has been arranged and a resin insulating layer has been formed, FIG. 5C illustrates a state in which electrodes have been formed on the resin insulating layer, FIG. 5D illustrates a state in which a wiring layer has been formed and FIG. 5E illustrates a state in which wiring electrodes have been formed on the wiring layer.

The coil module 1 of this embodiment differs from that of the above-described first embodiment in terms of the method of forming a wiring layer 120 and the coil component 30 as illustrated in FIG. 4. The following description will focus on parts that are different from the above-described first embodiment and since the other parts of the configuration are the same as in the first embodiment described above, the same symbols are used and description thereof is omitted.

An example of a method of manufacturing the coil module of this embodiment will be described while referring to FIGS. 4 and 5A to 5E.

First, a plate-shaped transfer body is prepared that supports on one surface thereof the other ends of a plurality of the first and second columnar conductors 13 and 14, which form the component-side coil electrode, and a plurality of the connection conductors 32, which are for forming external connection terminals. A donut-shaped prescribed region, which has substantially the same shape in plan view as the ring-shaped toroidal coil core 11, is set on the one surface of the transfer body. Then, a terminal assembly is formed by arranging the first columnar conductors 13 along the central axis (outer peripheral direction of prescribed region) of the coil 10 on the outside, which is one side, of the prescribed region, arranging the second columnar conductors 14 along the central axis direction (inner peripheral direction of prescribed region) of the coil 10 on the inside, which is the other side, of the prescribed region, arranging the first columnar conductors 13 and the second columnar conductors 14 so as to face each other with the prescribed region interposed therebetween and arranging the connection conductors 32 at prescribed positions.

Next, as illustrated in FIG. 5A, a terminal assembly is created by forming a support layer 41, which has an adhesive property, using a thermally curable resin (for example, a liquid resin) on a release sheet 40 and causing the one ends of the columnar conductors 13 and 14 and the connection conductors 32 to penetrate through the support layer 41. Next, the support layer 41 is thermally cured and the transfer body is removed. Therefore, the first and second columnar conductors 13 and 14 and the connection conductors 32 are simultaneously transferred to the support layer 41 on the release sheet 40. As the release sheet 40, any type of release sheet may be used such as a sheet obtained by forming a release layer on a resin sheet such as a polyethylene terephthalate, polyethylenenaphthalate or polyimide sheet, or a sheet where a resin sheet itself composed of a fluororesin has a release function.

Next, as illustrated in FIG. 5B, the coil core 11 is arranged between the first columnar conductors 13 and the second columnar conductors 14, and then the resin insulating layer 31, which includes the support layer 41, is formed by resin sealing the coil core 11, the columnar conductors 13 and 14 and the connection conductors 32 by using the same resin as the support layer 41. The resin insulating layer 31 may be formed by using a different resin from the support layer 41. In addition, a liquid resin may be used for the support layer 41 and a solid resin may be used as the resin used in the resin sealing step. Next, the release sheet 40 is removed, and then resin is removed from both main surfaces 31*a* and 31*b* of the resin insulating layer 31 by polishing or grinding such that both ends of the columnar conductors 13 and 14 and the connection conductors 32 are exposed.

Next, as illustrated in FIG. 5C, the component-side wiring electrode patterns 15 are formed on the one main surface 31*a* of the resin insulating layer 31 so as to connect the one ends of the pairs of first columnar conductors 13 and second columnar conductors 14 to each other. Then, the mounting electrodes 33, which are connected to the one ends of the connection conductors 32 exposed at the one main surface 31*a* of the resin insulating layer 31, are formed and manufacture of the coil component 30 is thus completed. The resin protective layer 34, which protects the component-side wiring electrode patterns 15 and the mounting electrodes 33, is formed on the one main surface 31*a* of the resin insulating layer 31 similarly to the first embodiment described above.

Furthermore, in this embodiment, a plurality of the substrate-side wiring electrode patterns 16 are formed on the other main surface 31*b* of the resin insulating layer 31. Each substrate-side wiring electrode pattern 16 connects the other end of a first columnar conductor 13 and the other end of a second columnar conductor 14, which is adjacent to one side of the second columnar conductor 14 that forms a pair with the first columnar conductor 13, to each other. In addition, a plurality of land electrodes 121 are formed on the other main surface 31*b* of the resin insulating layer 31. The land electrodes 121 are connected to the other ends of the connection conductors 32 and the columnar conductors 13 and 14 that are used as input/output terminals.

Next, as illustrated in FIG. 5D, a wiring layer 120, which functions as an adhesive layer, is formed on the other main surface 31*b* of the resin insulating layer 31 using a thermally curable resin such as epoxy resin. Thus, the substrate-side wiring electrode patterns 16 and the land electrodes 121 are formed on one main surface 120*a* of the wiring layer 120. Next, as illustrated in FIG. 5E, internal wiring electrodes 123 are formed by forming via conductors by forming via holes at prescribed positions in the wiring layer 120 by performing laser processing or the like and filling the formed via holes with a conductive paste.

In addition, land electrodes 122 are formed on another main surface 120*b* of the wiring layer 120. The land electrodes 122 on the other main surface 120*b* are connected to the land electrodes 121 on the one main surface 120*a* by the internal wiring electrodes 123. Then, as illustrated in FIG. 4, the coil module 1 is completed by mounting prescribed circuit components 2 on the other main surface 120*b* of the wiring layer 120.

In addition, similarly to the first embodiment described above, the wiring electrode patterns 15 and 16 and the land electrodes 121 and 122 are formed by etching metal foils (films) using photolithography or a resist film or are formed by applying a conductive paste containing Cu, Au or Ag using screen printing. In addition, plating may be applied to the patterns formed by screen printing. Furthermore, in the step illustrated in FIG. 5D, a wiring layer 120, which has the internal wiring electrodes 123 formed thereinside and has metal foil such as Cu foil adhered to the other main surface 120*b* thereof, may be stacked on the other main surface 31*b* of the resin insulating layer 31. In this case, in the step illustrated in FIG. 5E, it would be preferable for the land electrodes 122 to be formed by for example etching the metal foil adhered to the other main surface 120*b* of the resin insulating layer 31.

As described above, the land electrodes 121 and 122 and the internal wiring electrodes 123 are formed as a "wiring electrode" of the present disclosure.

Third Embodiment

Figure 6:
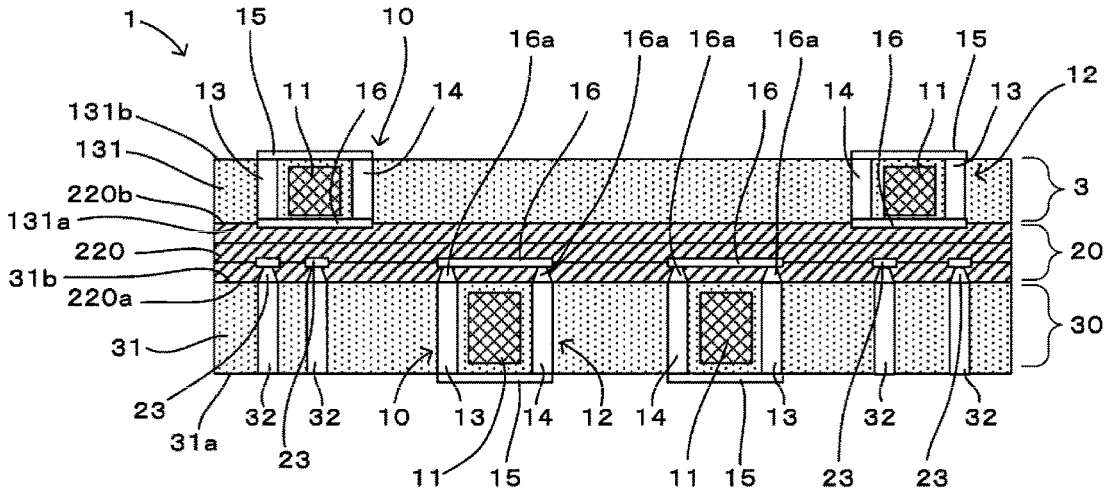
FIG. 6 is a partial sectional view illustrating a coil module according to a third embodiment of the present disclosure.

A coil module according to a third embodiment of the present disclosure will be described while referring to FIG. 6. FIG. 6 is a partial sectional view illustrating the coil module according to the third embodiment of the present disclosure.

The coil module 1 of this embodiment differs from that of the second embodiment described above in that, as illustrated in FIG. 6, the wiring substrate 20 includes a multilayer resin insulating layer 220, the coil component 30 is mounted on one main surface 220*a* of the multilayer resin insulating layer 220 and a coil component 3 (corresponding to a "component" of present disclosure) is mounted on another main surface 220*b* of the multilayer resin insulating layer 220. In addition, the coil electrode 12 is formed by forming second connection members of the one-side coil electrode, which forms part of the coil electrode 12 of the coil 10 of the coil component 30, out of the substrate-side wiring electrode patterns 16 and via conductors 16*a* in the multilayer resin insulating layer 220 and connecting the other-side coil electrode (columnar conductors 13 and 14 and component-side wiring electrode patterns 15) and the one-side coil electrode to each other.

Furthermore, a plurality of the connection conductors 32, which are connected to the internal wiring electrodes 23 of the wiring substrate 20, are provided in the resin insulating layer 31 of the coil component 30, similarly to the first and second embodiments described above. The following description will focus on parts that are different from the above-described second embodiment and since the other parts of the configuration are the same as in the second embodiment described above, the same symbols are used and description thereof is omitted.

The coil component 3, which is mounted on the other main surface 220*b* of the wiring substrate 20, has substantially the same configuration as the coil component 30, and includes a resin insulating layer 131 and the coil core 11 and the columnar conductors 13 and 14, which are buried in the resin insulating layer 131. Furthermore, a plurality of the component-side wiring electrode patterns 15, which connect the other ends of pairs of columnar conductors 13 and 14 to each other among the other ends of the columnar conductors 13 and 14 exposed at another main surface 131*b* of the resin insulating layer 131, are formed on the other main surface 131*b* of the resin insulating layer 131.

In addition, a plurality of the substrate-side wiring electrode patterns 16 are formed on the other main surface 220*b* of the wiring substrate 20. Among the one ends of the columnar conductors 13 and 14 exposed at one main surface 131*a* of the resin insulating layer 131, each substrate-side wiring electrode pattern 16 connects the one end of a first columnar conductor 13 and the one end of a second columnar conductor 14, which is adjacent to one side of the second columnar conductor 14 that forms a pair with the first columnar conductor 13, to each other. Then, the coil electrode 12 of the coil 10 is formed on the other main surface 220*b* of the wiring substrate 20 by connecting the columnar conductors 13 and 14 and the component-side wiring electrode patterns 15 of the coil component 3 to the substrate-side wiring electrode patterns 16, which are provided on the other main surface 220*b* of the wiring substrate 20.

The wiring substrate 20, which includes the multilayer resin insulating layer 220 in which wiring electrodes are formed, can be formed using a typical multilayer resin substrate forming process and therefore detailed description thereof is omitted. In addition, other circuit components 2 may be additionally provided on the wiring substrate 20 so as to be buried in the resin insulating layers 31 and 131.

(Modifications)

Figure 7:
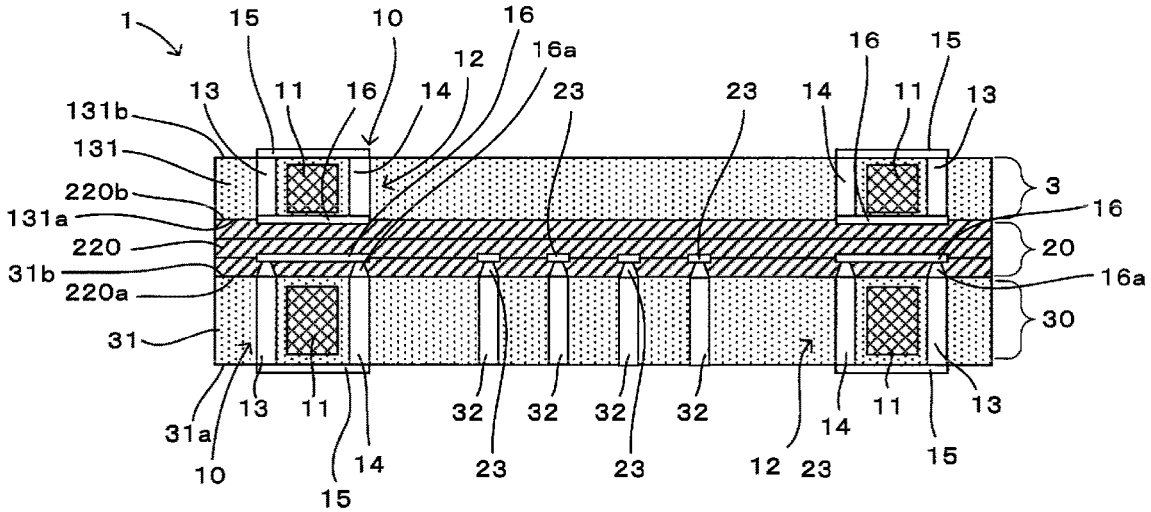
FIG. 7 illustrates a modification of the coil module of FIG. 6.

A modification of a coil module will be described while referring to FIG. 7. FIG. 7 illustrates a modification of the coil module of FIG. 6.

The modification illustrated in FIG. 7 differs from the coil module 1 illustrated in FIG. 6 in that the connection conductors 32, which are provided in the resin insulating layer 31 of the coil component 30, are arranged inside the coil core 11. The rest of the configuration is the same as that of the coil module 1 of FIG. 6 and therefore the same reference symbols are used and description thereof is omitted.

Figure 8:
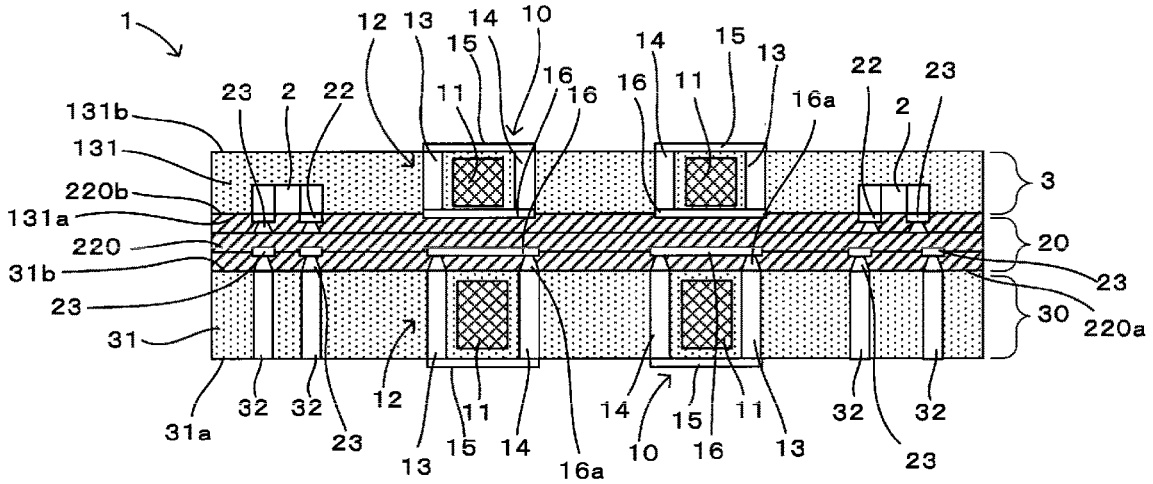
FIG. 8 illustrates a modification of the coil module of FIG. 6.

A modification of a coil module will be described while referring to FIG. 8. FIG. 8 illustrates a modification of the coil module of FIG. 6.

The modification illustrated in FIG. 8 differs from the coil module 1 illustrated in FIG. 6 in that other circuit components 2 are additionally mounted on the wiring substrate 20 so as to be buried in the resin insulating layer 131 of the coil component 3. The circuit components 2 are arranged outside the coil core 11. The rest of the configuration is the same as that of the coil module 1 of FIG. 6 and therefore the same reference symbols are used and description thereof is omitted.

Figure 9:
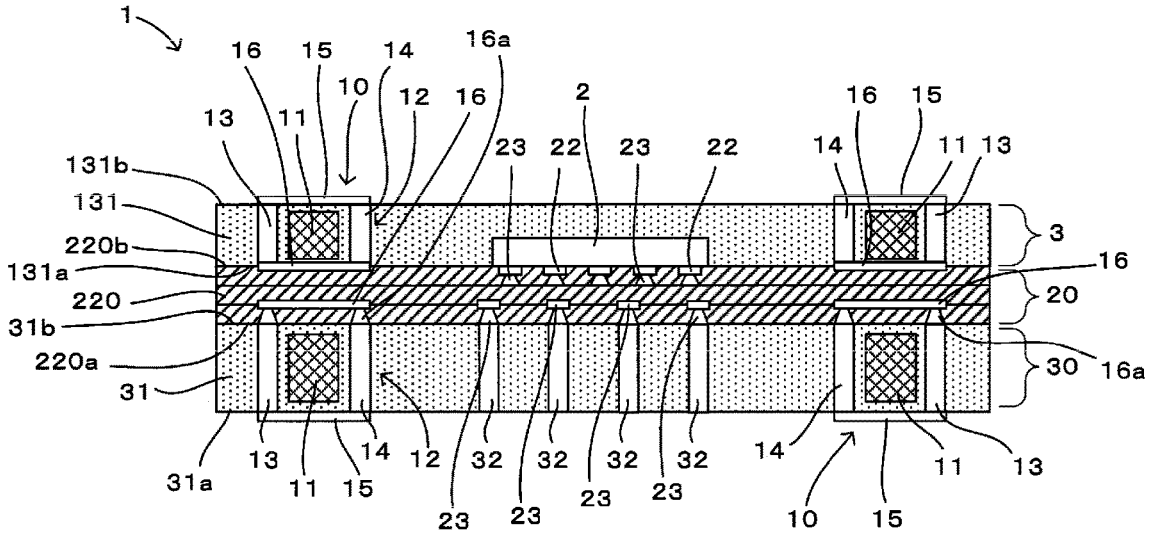
FIG. 9 illustrates a modification of the coil module of FIG. 7.

A modification of a coil module will be described while referring to FIG. 9. FIG. 9 illustrates a modification of the coil module of FIG. 7.

The modification illustrated in FIG. 9 differs from the coil module 1 illustrated in FIG. 7 in that another circuit components 2 is additionally mounted on the wiring substrate 20 so as to be buried in the resin insulating layer 131 of the coil component 3. The circuit component 2 is arranged inside the coil core 11. The rest of the configuration is the same as that of the coil module 1 of FIG. 7 and therefore the same reference symbols are used and description thereof is omitted.

The substrate-side wiring electrode patterns 16 illustrated in FIGS. 6 to 9 may be formed of metal pins. In this case, the substrate-side wiring electrode patterns 16 can be formed by forming grooves, in which metal pins are to be arranged, in a main surface of the layer of the multilayer resin insulating layer 220 in which the substrate-side wiring electrode patterns 16 are to be formed and then arranging the metal pins in the grooves.

As described above, in these embodiments, coil components 3 and 30 of different heights in which the coil cores 11 have different thicknesses are arranged on both main surfaces of the wiring substrate 20, as illustrated in FIGS. 6 to 9. If a plurality of coils 10 having coil cores 11 of different heights (thicknesses) are arranged on the same main surface of the wiring substrate 20, the heights (lengths) of the metal pins needed to form the coils 10 are different and therefore forming the structure is difficult and inconvenient. On the other hand, if the coils 10 are formed to have the same height in order to allow the coils 10 to be arranged on the same main surface of the wiring substrate 20, the lengths of the metal pins become wastefully long. Consequently, the size of the coil module 1 is increased. Therefore, an increase in the size of the coil module 1 can be prevented by respectively arranging coils 10 of different heights on the two main surfaces of the wiring substrate 20.

In addition, wiring electrodes including the substrate-side wiring electrode patterns 16 and the via conductors 16*a* can be formed by utilizing the multilayer structure of the multilayer resin insulating layer 220 of the wiring substrate 20, which has the coil components 3 and 30 mounted on the two main surfaces 220*a* and 220*b* thereof. Therefore, compared with the configuration of the coil component 500 of the related art illustrated in FIG. 17 in which the wiring electrode patterns that form the coil electrode are formed on the main surfaces of the resin insulating layer 31 or 131 in which the coil core 11 is buried, the distance between the coil core 11 and the substrate-side wiring electrode patterns 16 can be increased by forming the substrate-side wiring electrode patterns 16 and the via conductors 16*a* on inner layers of the multilayer resin insulating layer 220, for example. Therefore, stress acting on the coil core 11 from the coil electrode 12 can be relaxed and consequently the coil characteristics can be improved. In addition, a further reduction in profile over the configuration of the related art can be achieved by forming the substrate-side wiring electrode patterns 16 on inner layers of the multilayer resin insulating layer 220.

Fourth Embodiment

Figure 10:
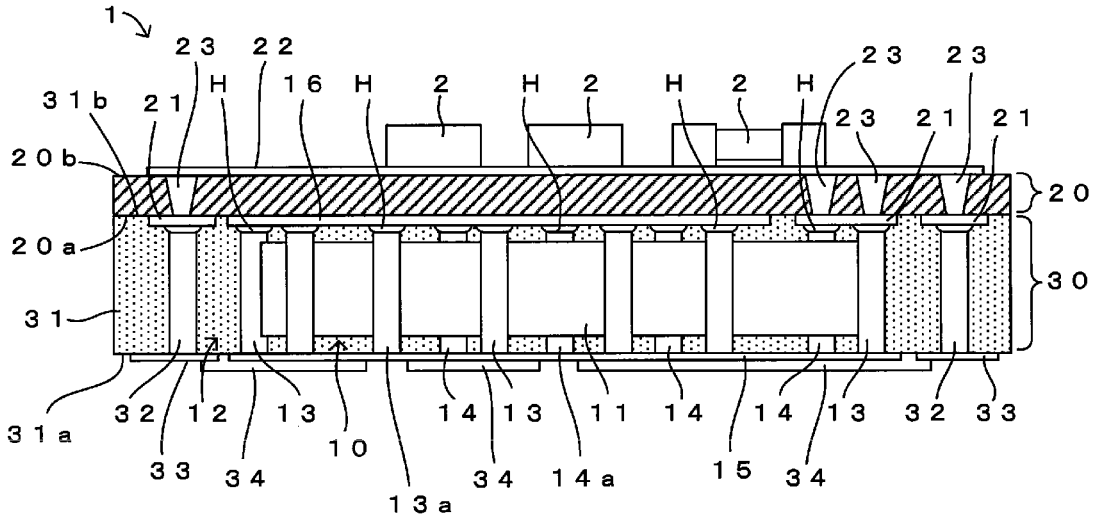
FIG. 10 is a partial sectional view illustrating a coil module according to a fourth embodiment of the present disclosure.

A coil module according to a fourth embodiment of the present disclosure will be described while referring to FIGS. 10 and 11. FIG. 10 is a partial sectional view illustrating the coil module according to the fourth embodiment of the present disclosure and FIG. 11 illustrates a circuit configuration of the coil module of FIG. 10.

Figure 11:
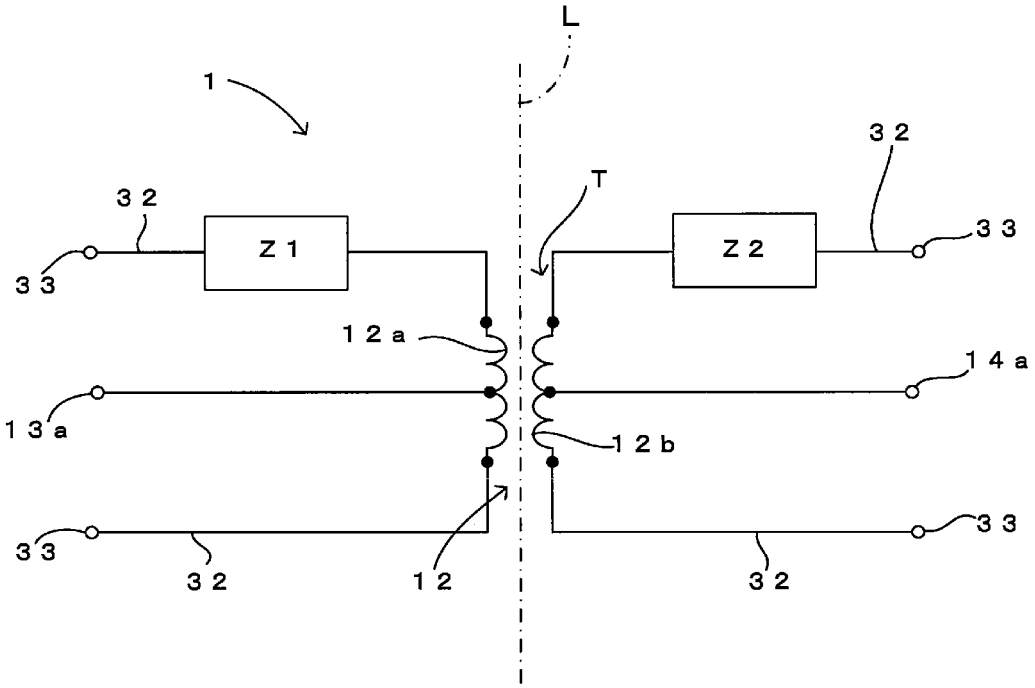
FIG. 11 illustrates a circuit configuration of the coil module of FIG. 10.

The coil module 1 of this embodiment differs from the first embodiment described above in that the coil electrode 12 includes a primary-side electrode group 12*a* that forms the primary coil of a transformer T and a secondary-side electrode group 12*b* that forms the secondary coil of the transformer T, as illustrated in FIG. 11. The following description will focus on parts that are different from the above-described first embodiment and since the other parts of the configuration are the same as in the first embodiment described above, the same symbols are used and description thereof is omitted.

In this embodiment, as illustrated in FIG. 11, the primary-side electrode group 12*a* and circuit components 2, which form an electrical circuit Z1 that is connected to the primary-side electrode group 12*a*, are arranged in one region (left region in same figure) partitioned by a prescribed boundary line L in plan view. In addition, the secondary-side electrode group 12*b* and circuit components 2 that form an electrical circuit Z2 that is connected to the secondary-side electrode group 12*b* are arranged in another region (right region in same figure) partitioned by the prescribed boundary line L in plan view.

Furthermore, the first columnar conductors 13 and/or the second columnar conductors 14 include connection-use columnar conductors 13*a* and 14*a*, which are for realizing external connections. Specifically, in this embodiment, the first columnar conductors 13 include a connection-use columnar conductor 13*a*, which is for realizing an external connection for leading out a signal from midway along a line of the primary-side electrode group 12*a*. In addition, the second columnar conductors 14 include a connection-use columnar conductor 14*a*, which is for realizing an external connection for leading out a signal from midway along a line of the secondary-side electrode group 12*b*. Furthermore, as illustrated in FIG. 10, the connection-use columnar conductors 13*a* and 14*a* are exposed at the one main surface 31*a* of the resin insulating layer 31 as external connection terminals by providing openings at prescribed positions in the resin protective layer 34 provided on the one main surface 31*a* of the resin insulating layer 31 of the coil component 30.

A signal of the primary-side electrode group 12*a* may be lead out by the connection-use columnar conductor 14*a* included in the second columnar conductors 14 and a signal of the secondary-side electrode group 12*b* may be lead out by the connection-use columnar conductor 13*a* included in the first columnar conductors 13.

(Modification)

Figure 12:
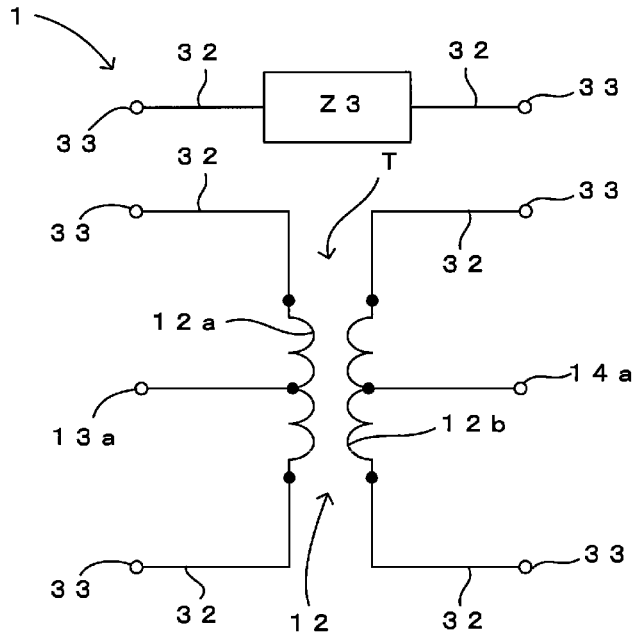
FIG. 12 illustrates a modification of the circuit configuration of FIG. 11.

A modification of the circuit configuration will be described while referring to FIG. 12. FIG. 12 illustrates a modification of the circuit configuration of FIG. 11.

The circuit configuration illustrated in FIG. 12 differs from the circuit configuration illustrated in FIG. 11 in that the transformer T (primary-side electrode group 12*a* and secondary-side electrode group 12*b*) is not electrically connected to an electrical circuit Z3 formed of coil components 2 of the coil module 1. The rest of the configuration is the same as that of the coil module 1 of FIG. 10 and therefore the same reference symbols are used and description thereof is omitted.

As described above, in this embodiment, the first columnar conductors 13 and/or the second columnar conductors 14 include connection-use columnar conductors 13*a* and 14*b* that are for realizing external connections and one ends of the connection-use columnar conductors 13*a* and 14*a* are exposed at the one main surface 31*a* of the resin insulating layer 31 as external connection terminals. Therefore, the coil 10 (transformer T) of the coil module 1 can be connected to another substrate over the shortest distance without an intermediary of a wiring electrode provided on the wiring substrate 20 by connecting external connection terminals, which are formed by the one ends of the connection-use columnar conductors 13*a* and 14*b* exposed at the one main surface 31*a* of the resin insulating layer 31, to the another substrate such as an external mother substrate. In addition, external connection terminals, which function as lead-out terminals that can lead out a signal from an arbitrary position along the coil electrode 12, can be easily formed by configuring arbitrary columnar conductors among the first and second columnar conductors 13 and 14 as the connection-use columnar conductors 13*a* and 14*a*.

In addition, the coil electrode 12 includes the primary-side electrode group 12*a* that forms the primary coil of the transformer T and the secondary-side electrode group 12*b* that forms the secondary coil of the transformer T. Furthermore, the primary-side electrode group 12*a* and circuit components 2 that are connected to the primary-side electrode group 12*a* are arranged in one region partitioned by a prescribed boundary line L in plan view. In addition, the secondary-side electrode group 12*b* and circuit components 2 that are connected to the secondary-side electrode group 12*b* are arranged in another region partitioned by the prescribed boundary line L in plan view.

Therefore, the coil module 1 can be provided that has a useful configuration in which the circuit components 2 on the primary-coil side of the transformer T and the circuit components 2 on the secondary-coil side of the transformer T are arranged so as to be isolated from each other with the boundary line L interposed therebetween.

Fifth Embodiment

Figure 13:
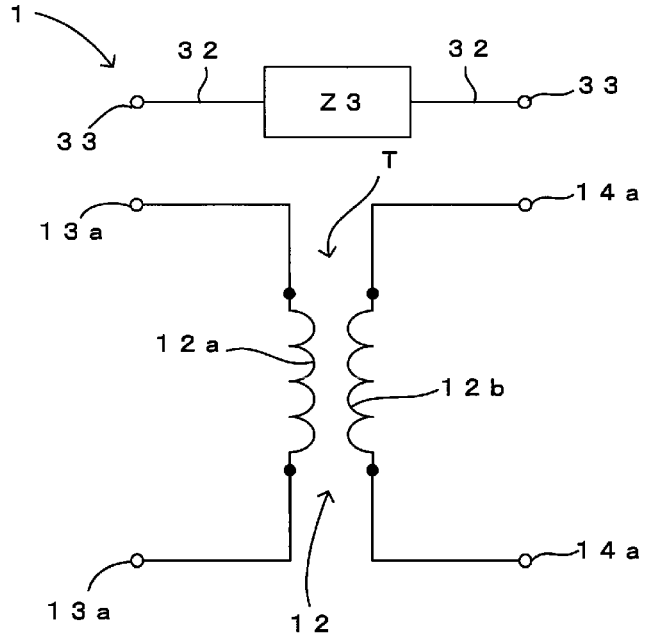
FIG. 13 illustrates a circuit configuration of a coil module according to a fifth embodiment of the present disclosure.

A coil module according to a fifth embodiment of the present disclosure will be described while referring to FIG. 13. FIG. 13 illustrates a circuit configuration of the coil module according to the fifth embodiment of the present disclosure.

The circuit configuration of the coil module 1 of this embodiment differs from the circuit configuration of the coil module 1 illustrated in FIG. 12 is that one end of the primary-side electrode group 12*a* is connected to one connection-use columnar conductor 13*a* and the other end of the primary-side electrode group 12*a* is connected to another connection-use columnar conductor 13*a*. In addition, one end of the secondary-side electrode group 12*b* is connected to one connection-use columnar conductor 14*a* and the other end of the secondary-side electrode group 12*b* is connected to another connection-use columnar conductor 14*a*. In addition, the transformer T (primary-side electrode group 12*a* and secondary-side electrode group 12*b*) is not electrically connected to the electrical circuit Z3 formed of circuit components 2 in the coil module 1. The rest of the configuration is the same as that of the coil module 1 of FIG. 12 and therefore the same reference symbols are used and description thereof is omitted.

In this embodiment, at least two connection-use columnar conductors 13*a* are provided for the primary-side electrode group 12*a* and at least two connection-use columnar conductors 14*a* are provided for the secondary-side electrode group 12*b*. One end of the primary-side electrode group 12*a* is connected to one connection-use columnar conductor 13*a*, the other end of the primary-side electrode group 12*a* is connected to another connection-use columnar conductor 13*a*, one end of the secondary-side electrode group 12*b* is connected to one connection-use columnar conductor 14*a* and the other end of the secondary-side electrode group 12*b* is connected to another connection-use columnar conductor 14*a*.

Therefore, input/output terminals of the primary coil can be simply formed of external connection terminals that are formed of the one end of the one connection-use columnar conductor 13*a* that is connected to the one end of the primary-side electrode group 12*a* and the one end of the other connection-use columnar conductor 13*a* that is connected to the other end of the primary-side electrode group 12*a*. In addition, input/output terminals of the secondary coil can be simply formed of external connection terminals that are formed of the one end of the one connection-use columnar conductor 14*a* that is connected to the one end of the secondary-side electrode group 12*b* and the one end of the other connection-use columnar conductor 14*a* that is connected to the other end of the secondary-side electrode group 12*b*. Furthermore, since the transformer T and the other circuit components 2 of the coil module 1 are not electrically connected to each other, the transformer T of the coil module can be connected to another substrate over the shortest distance in a state where the transformer T and the other circuit components 2 of the coil module 1 are electrically isolated from each other by using the input/output terminals formed by the connection-use columnar conductors 13*a* and 14*a*.

Signals of the primary-side electrode group 12*a* and the secondary-side electrode group 12*b* may be led out by the connection-use columnar conductor 13*a* and/or the connection-use columnar conductor 14*a*. In addition, similarly to the fourth embodiment described above, signals may be led out from midway along lines of the primary-side electrode group 12*a* and the secondary-side electrode group 12*b*.

Sixth Embodiment

Figure 14:
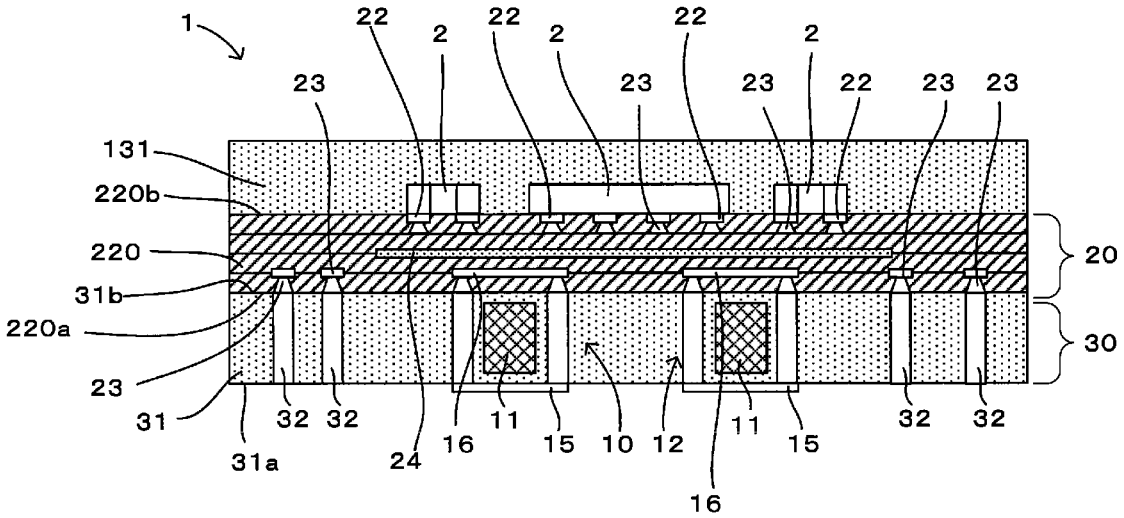
FIG. 14 is a partial sectional view illustrating a coil module according to a sixth embodiment of the present disclosure.

A coil module according to a sixth embodiment of the present disclosure will be described while referring to FIG. 14. FIG. 14 is a partial sectional view illustrating the coil module according to the sixth embodiment of the present disclosure.

The coil module 1 of this embodiment differs from the coil module 1 illustrated in FIG. 6 in that, as illustrated in FIG. 14, a plurality of circuit components 2 are mounted on the wiring substrate 20 so as to be buried in the resin insulating layer 131 and wiring electrodes provided in the multilayer resin insulating layer 220 of the wiring substrate 20 include a planar shielding electrode 24 provided between the coil electrode 12 and the circuit components 2. The rest of the configuration is the same as that of the coil module 1 of FIG. 6 and therefore the same reference symbols are used and description thereof is omitted.

In this embodiment, the wiring electrodes of the multilayer resin insulating layer 220 (wiring substrate 20) include the planar shielding electrode 24 provided between the coil electrode 12 and the circuit components 2. Therefore, since the planar shielding electrode 24 is provided between the coil electrode 12 and the circuit components 2, the coil 10 can be prevented from affecting the circuit components 2 mounted in the coil module 1.

Seventh Embodiment

Figure 15:
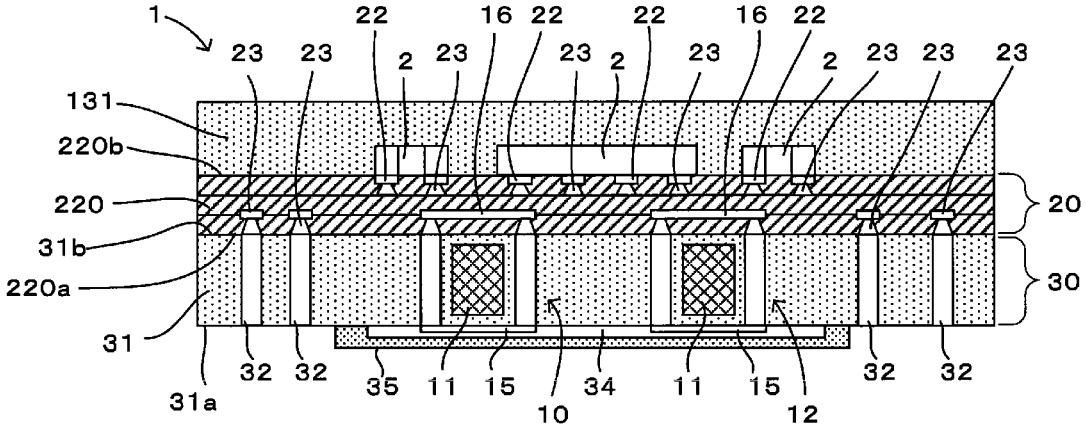
FIG. 15 is a partial sectional view illustrating a coil module according to a seventh embodiment of the present disclosure.

A coil module according to a seventh embodiment of the present disclosure will be described while referring to FIG. 15. FIG. 15 is a partial sectional view illustrating the coil module according to the seventh embodiment of the present disclosure.

The coil module 1 of this embodiment differs from the coil module 1 illustrated in FIG. 6 in that, as illustrated in FIG. 15, a shield layer 35 is provided on the one main surface 31*a* of the resin insulating layer 31 so as to cover the resin protective layer 34. In addition, a plurality of circuit components 2 are mounted on the wiring substrate 20 so as to be buried in the resin insulating layer 131. The rest of the configuration is the same as that of the coil module 1 of FIG. 6 and therefore the same reference symbols are used and description thereof is omitted.

In this embodiment, the shield layer 35 is provided on the one main surface 31*a* of the resin insulating layer 31. Therefore, since the shield layer 35 is arranged between the coil 10 of the coil module 1 and another substrate on which the coil module 1 is mounted, the coil 10 mounted in the coil module 1 can be prevented from affecting the other substrate. In addition, the effect of the other substrate on the coil module 1 can be suppressed.

Figure 16A:
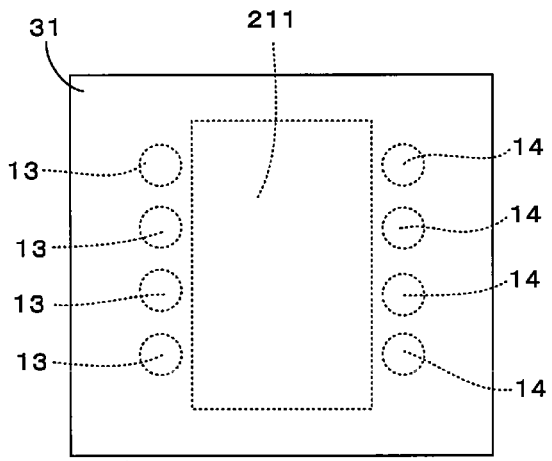
FIG. 16A illustrates a linear coil core and FIG. 16B illustrates a substantially C-shaped coil core.
Figure 16B:
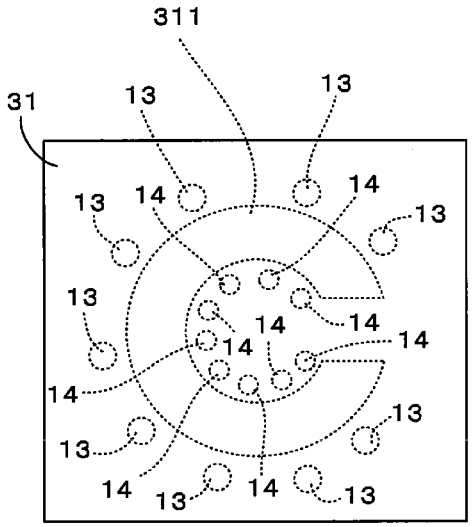

In addition, the present disclosure is not limited to the above-described embodiments and various modifications not described above can be made so long as they do not deviate from the gist of the disclosure and the configurations of the above-described embodiments may be combined in any manner with each other. For example, in the above-described embodiments, a ring-shaped toroidal coil core 11 is taken as an example, but the shape of the coil core is not limited to a toroidal shape. For example, a coil core having any of various shapes can be adopted such as a linear coil core 211 illustrated in FIG. 16A or a substantially C-shaped coil core 311 illustrated in FIG. 16B. Furthermore, the coil of the coil module can form a coil that has any of various functions such as that of a common mode noise filter or a choke coil. Each of FIGS. 16A and 16B illustrates modifications of the coil core and illustrates the arrangement relationship between the coil cores 211 and 311 and the first and second columnar conductors 13 and 14 inside the resin insulating layer 31, where FIG. 16A illustrates the linear coil core and FIG. 16B illustrates the substantially C-shaped coil core.

In addition, the first and second columnar conductors and/or the connection conductors may be formed of via conductors formed by filling the insides of through holes formed in the resin insulating layer 31 with conductive paste or plating the insides of the through holes, for example.

The present disclosure can be broadly applied to coil modules that are equipped with a coil that includes a coil core and a coil electrode that is wound around the periphery of the coil core in a spiral shape.

1 coil module
2 circuit component (component)
3 coil component (component)
10 coil
11, 211, 311 coil core
12 coil electrode
12*a* primary-side electrode group
12*b* secondary-side electrode group
13 first columnar conductor (other-side coil electrode)
13*a*, 14*a* connection-use columnar conductor
14 second columnar conductor (other-side coil electrode)
15 component-side wiring electrode pattern (other-side coil electrode, first connection member)
16 substrate-side wiring electrode pattern (wiring electrode, one-side coil electrode, second connection member)

16*a* via conductor (wiring electrode, one-side coil electrode, second connection member)
20 wiring substrate (wiring layer)
20*a*, 120*a*, 220*a* one main surface
20*b*, 120*b*, 220*b* other main surface
21, 22, 121, 122 land electrodes (wiring electrode)
23, 123 internal wiring electrode (wiring electrode)
24 shielding electrode (wiring electrode)
31 resin insulating layer
31*a* one main surface
31*b* other main surface
32 connection conductor
35 shield layer
120 wiring layer
L boundary line
T transformer

The invention claimed is:

1. A coil module equipped with a coil including a coil core and a coil electrode wound around a periphery of the coil core in a spiral shape, the coil module comprising:

a wiring layer having a first main surface and an opposing second main surface, the wiring layer provided with a wiring electrode including a one-side coil electrode comprising a part of the coil electrode, the one-side coil electrode comprising a first land electrode disposed on the first main surface of the wiring layer, a second land electrode disposed on the second main surface of the wiring layer, and an internal wiring electrode disposed between and connecting the first and second land electrodes;

a resin insulating layer having a first main surface and an opposing second main surface, the resin insulating layer being disposed on the first main surface of the wiring layer such that the second main surface of the resin insulating layer contacts the first main surface of the wiring layer, the resin insulating layer having the coil core buried therein and provided with another-side coil electrode comprising a remaining part of the coil electrode;

a component provided on the wiring layer and connected to the wiring electrode; and a plurality of columnar connection conductors buried in and only extending in the resin insulating layer, wherein one end of each of the plurality of columnar connection conductors is exposed at the first main surface of the resin insulating layer as an external connection terminal and another end of each of the plurality of columnar connection conductors is connected to the first land electrode of the wiring electrode of the wiring layer, wherein the first main surface of the resin insulating layer is located on an opposite side to the wiring layer;

wherein the coil electrode comprises the another-side coil electrode of the resin insulating layer connected to the one-side coil electrode of the wiring layer.

2. The coil module according to claim 1, wherein the another-side coil electrode of the resin insulating layer includes:

a plurality of first columnar conductors buried in the resin insulating layer, arranged so as to intersect a direction of a central axis of the coil, arranged on one side of the coil core, wherein one end of each of the plurality of first columnar conductors is exposed at the first main surface of the resin insulating layer and another end of each of the plurality of first columnar conductors is exposed at the second main surface of the resin insulating layer, a plurality of second columnar conductors buried in the resin insulating layer, arranged so as to intersect the direction of the central axis of the coil, arranged on another side of the coil core such that the coil core is interposed between the plurality of second columnar conductors and the plurality of first columnar conductors, wherein one end of each of the plurality of second columnar conductors is exposed at the first main surface of the resin insulating layer and another end of each of the plurality of second columnar conductors is exposed at the second main surface of the resin insulating layer, and a plurality of first connection members located on the first main surface of the resin insulating layer and connecting the one ends of pairs of the first columnar conductors and the second columnar conductors to each other, and wherein the one-side coil electrode of the wiring layer further includes:

a plurality of second connection members located on the first main surface of the wiring layer, each of the second connection members connecting the another end of a first columnar conductor to the another end of a second columnar conductor adjacent to one side of the second columnar conductor comprising a pair with the first columnar conductor to each other.

3. The coil module according to claim 2, wherein the coil core of the coil has a toroidal shape, and the first columnar conductors are arranged along an outer peripheral surface of the coil core on an outside of the coil core, wherein the outside of the coil core is the one side of the coil core, and the second columnar conductors are arranged along an inner peripheral surface of the coil core on an inside of the coil core, wherein the inside of the coil core is the another side of the coil core.

4. The coil module according to claim 2, wherein the connection conductors, the first columnar conductors and the second columnar conductors comprise metal pins.

5. The coil module according to claim 2, wherein at least either of the first columnar conductors and the second columnar conductors includes one or more connection-use columnar conductors for realizing an external connection, and one end of the connection-use columnar conductor is exposed at the first main surface of the resin insulating layer as an external connection terminal.

6. The coil module according to claim 5, wherein the one or more connection-use columnar conductors include at least two connection-use columnar conductors, one end of the coil electrode is connected to one of the connection-use columnar conductors, another end of the coil electrode is connected to another one of the connection-use columnar conductors, and the coil electrode and the component are not electrically connected to each other.

7. The coil module according to claim 1, wherein one end of the coil electrode is connected to one of the connection conductors via the wiring electrode of the wiring layer and another end of the coil electrode is connected to another one of the connection conductors via the wiring electrode of the wiring layer.

8. The coil module according to claim 1, wherein the wiring electrode of the wiring layer includes a planar shielding electrode provided between the coil electrode and the component.

9. The coil module according to claim 1, wherein a shield layer is provided on the first main surface of the resin insulating layer.

10. The coil module according to claim 1, wherein the coil electrode includes a primary-side electrode group comprising a primary coil of a transformer and a secondary-side electrode group comprising a secondary coil of the transformer, and the primary-side electrode group and a component connected to the primary-side electrode group are arranged in one region partitioned by a prescribed boundary line in a plan view, and the secondary-side electrode group and a component connected to the secondary-side electrode group are arranged in another region partitioned by the prescribed boundary line in a plan view.

11. The coil module according to claim 1, wherein another coil is further arranged on the second main surface of the wiring layer, and a thickness of the coil core of the coil arranged on the first main surface of the wiring layer and a thickness of a coil core of the another coil arranged on the second main surface of the wiring layer are different from each other.

12. The coil module according to claim 3, wherein the connection conductors, the first columnar conductors and the second columnar conductors comprise metal pins.

13. The coil module according to claim 3, wherein at least either of the first columnar conductors and the second columnar conductors includes one or more connection-use columnar conductors for realizing an external connection, and one end of the connection-use columnar conductor is exposed at the first main surface of the resin insulating layer as an external connection terminal.

14. The coil module according to claim 4, wherein at least either of the first columnar conductors and the second columnar conductors includes one or more connection-use columnar conductors for realizing an external connection, and one end of the connection-use columnar conductor is exposed at the first main surface of the resin insulating layer as an external connection terminal.

15. The coil module according to claim 2, wherein one end of the coil electrode is connected to one of the connection conductors via the wiring electrode of the wiring layer and another end of the coil electrode is connected to another one of the connection conductors via the wiring electrode of the wiring layer.

16. The coil module according to claim 3, wherein one end of the coil electrode is connected to one of the connection conductors via the wiring electrode of the wiring layer and another end of the coil electrode is connected to another one of the connection conductors via the wiring electrode of the wiring layer.

17. The coil module according to claim 4, wherein one end of the coil electrode is connected to one of the connection conductors via the wiring electrode of the wiring layer and another end of the coil electrode is connected to another one of the connection conductors via the wiring electrode of the wiring layer.

18. The coil module according to claim 5, wherein one end of the coil electrode is connected to one of the connection conductors via the wiring electrode of the wiring layer and another end of the coil electrode is connected to another one of the connection conductors via the wiring electrode of the wiring layer.

19. The coil module according to claim 2, wherein the wiring electrode of the wiring layer includes a planar shielding electrode provided between the coil electrode and the component.

20. The coil module according to claim 3, wherein the wiring electrode of the wiring layer includes a planar shielding electrode provided between the coil electrode and the component.

* * * * *